US007176913B2

(12) United States Patent
Yamada et al.

(10) Patent No.: US 7,176,913 B2
(45) Date of Patent: Feb. 13, 2007

(54) DRIVE CIRCUIT FOR FLAT DISPLAY APPARATUS AND FLAT DISPLAY APPARATUS

(75) Inventors: Yasuo Yamada, Tokyo (JP); Masanori Yamaguchi, Kanagawa (JP)

(73) Assignee: Sony Corporation (JP)

( * ) Notice: Subject to any disclaimer, the term of this patent is extended or adjusted under 35 U.S.C. 154(b) by 67 days.

(21) Appl. No.: 11/122,006

(22) Filed: May 5, 2005

(65) Prior Publication Data

US 2005/0253831 A1 Nov. 17, 2005

(30) Foreign Application Priority Data

May 12, 2004 (JP) ..... P2004-142295

(51) Int. Cl.
*G09G 5/00* (2006.01)
*H03M 1/66* (2006.01)

(52) U.S. Cl. ..... 345/213; 345/690; 345/211; 345/98; 341/144; 341/112

(58) Field of Classification Search ..... None
See application file for complete search history.

(56) References Cited

U.S. PATENT DOCUMENTS

| | | | | |
|---|---|---|---|---|
| 6,844,839 | B2 * | 1/2005 | Lee et al. | 341/144 |
| 2001/0045947 | A1 * | 11/2001 | Nishitani et al. | 345/213 |
| 2004/0187574 | A1 * | 9/2004 | Lee et al. | 345/95 |
| 2004/0212574 | A1 * | 10/2004 | Iwasaki | 345/87 |

FOREIGN PATENT DOCUMENTS

JP 10-333648 12/1998

* cited by examiner

*Primary Examiner*—Tuyet Thi Vo
(74) *Attorney, Agent, or Firm*—Rader Fishman & Grauer PLLC; Ronald P. Kananen

(57) ABSTRACT

A drive circuit for a flat display apparatus is disclosed wherein different display objects can be displayed at a time individually with appropriate gamma characteristics. Reference voltages are produced in a plurality of systems having different gamma characteristics from each other, and one of the systems is selected in response to a selection signal. Then, the reference voltages of the selected system are selected in response to image data to set gradations of pixels.

9 Claims, 18 Drawing Sheets

DRIVE CIRCUIT FOR FLAT DISPLAY APPARATUS AND FLAT DISPLAY APPARATUS

BACKGROUND OF THE INVENTION

This invention relates to a drive circuit for a flat display apparatus and a flat display apparatus which can be applied to a display apparatus which is configured using, for example, organic EL (Electro Luminescence) devices.

Conventionally, a liquid crystal display apparatus which is one of a flat display apparatus, is configured such that the gamma characteristic is changed over by the setting of a reference voltage to be used for a digital to analog conversion process as disclosed, for example, in Japanese Patent Laid-Open No. Hei 10-333648 (hereinafter referred to as Patent Document 1).

A typical liquid crystal display apparatus is shown in FIG. 16. Referring to FIG. 16, the liquid crystal display apparatus 1 shown includes a display section 2 in which pixels (P) 3R, 3G, 3B, each formed from a liquid crystal cell, a switching element for the liquid crystal cell and a holding capacitor are arranged in a matrix. In the liquid crystal display apparatus 1, each of the pixels 3R, 3G, 3B is connected to a horizontal drive circuit 4 and a vertical drive circuit 5 through a signal line (column line) SIG and a gate line (row line) G, respectively. The vertical drive circuit 5 successively selects the pixels 3R, 3G, 3B while the horizontal drive circuit 4 sets the gradations of the pixels 3R, 3G, 3B using driving signals therefrom thereby to display a desired image. Further, the pixels 3R, 3G, 3B having color filters of red, green and blue provided therefor are arranged successively and cyclically so that a color image can be displayed.

To this end, in the liquid crystal display apparatus 1, image data DR, DG, DB of red, green and blue to be used for display are inputted simultaneously and parallelly from an apparatus body 6 to a controller 7, and the gate lines G of the display section 2 are driven by the vertical drive circuit 5 with timing signals synchronized with the image data DR, DG, DB. Further, the image data DR, DG, DB are time division multiplexed to produce a single series of image data D1 so as to correspond to driving of the signal lines SIG by the horizontal drive circuit 4, and the signal lines SIG are driven by the horizontal drive circuit 4 with the thus produced image data D1.

FIG. 17 is a block diagram showing a detailed configuration of the horizontal drive circuit 4 and the controller 7 together with an associated element. Referring to FIG. 17, the controller 7 successively stores and outputs image data DR, DG, DB outputted from the apparatus body 6 into and from a memory 10 under the control of a memory control circuit 9 to time division multiplex and output the image data DR, DG, DB in a single system such that image data of the same color may successively appear in a unit of a line in a unit of a horizontal scanning period so as to correspond to driving of the signal lines SIG by the horizontal drive circuit 4. More particularly, the horizontal drive circuit 4 successively drives the red pixels 3R, the green pixels 3G and the blue pixels 3B in a unit of a line, and consequently, the controller 7 outputs the image data D1 such that the red image data DR, the green image data DG and the blue image data DB are repeated successively and cyclically in a unit of a line as seen from FIG. 18B.

The controller 7 produces various timing signals synchronized with the image data D1 by means of a timing generator (TG) 11 and outputs the timing signals to the horizontal drive circuit 4 and the vertical drive circuit 5. It is to be noted that the timing signals include a clock CK (FIG. 18A) for the image data D1, a start pulse ST (FIG. 18C) and a strobe pulse (FIG. 18D) indicative of timings of a start and an end of the image data DR, DG, DB of the different colors of the image data D1.

The controller 7 produces original reference voltages VRT, VB to VG, VRB, which are used as references for production of reference voltages to be used for a digital analog conversion process, by means of an original reference signal production circuit 12 and outputs them to the horizontal drive circuit 4.

The horizontal drive circuit 4 inputs image data D1 outputted from the controller 7 to a shift register 13 so that the image data D1 are successively distributed and outputted to systems of signal lines of the display section 2. The reference voltage production circuit 14 produces and outputs reference voltages V1 to V64, which correspond to different gradations of the image data D1, from the original reference voltages VRT, VB to VG, VRB inputted thereto from the controller 7.

Digital to analog conversion circuits (D/A) 15A to 15N perform a digital to analog conversion process for output data of the shift register 13 and output drive signals which are time division multiplexed drive signals of three adjacent ones of the signal lines SIG. The digital to analog conversion circuits 15A to 15N selectively output the reference voltages V1 to V64 produced by a reference voltage production circuit 14 in response to output data of the shift register 13 to perform a digital to analog conversion process of the image data outputted from the shift register 13.

Amplification circuits 16A to 16N amplify and output the output signals of the digital to analog conversion circuits 15A to 15N to the display section 2, respectively. In the display section 2, the output signals of the amplification circuits 16A to 16N are successively and cyclically outputted to the signal lines SIG for the pixels 3R, 3G, 3B of red, green and blue by means of selectors 17A to 17N, respectively.

In this manner, the reference voltages V1 to V64 produced from the original reference voltages VRT, VB to VG, VRB are selectively used to produce drive signals for the signal lines SIG. FIG. 19 shows in block diagram a configuration of the original reference signal production circuit 12 used to produce the original reference voltages VRT, VB to VG, VRB and the reference voltage production circuit 14 used to produce the reference voltages V1 to V64.

Referring to FIG. 19, the original reference signal production circuit 12 shown includes a voltage dividing circuit 21 formed from a predetermined number of resisters connected in series. The voltage dividing circuit 21 divides a reference voltage production voltage VCOM to produce the original reference voltages VRT, VB to VG, VRB. Consequently, the original reference signal production circuit 12 produces the original reference voltages VRT, VB to VG, VRB by resistor voltage division and outputs them through amplification circuits 24A to 27H. It is to be noted that the original reference signal production circuit 12 is configured such that the voltage to be applied to the voltage dividing circuit 21 is changed over by a selection circuit 22 and an inversion amplification circuit 23 so as to cope with line inversion or frame inversion. FIG. 18F illustrates the potential of a signal line SIG where line inversion is involved.

Meanwhile, the reference voltage production circuit 14 includes a resistor series circuit 26 formed from voltage dividing circuits R1 to R7 connected in series. Each of the voltage dividing circuits R1 to R7 includes a predetermined number of resistors having an equal resistance value and connected in series. The original reference voltages VRT, VB to VG, VRB are inputted through amplification circuits 27A to 27H to one end of the resistor series circuit 26, nodes of the voltage dividing circuits R1 to R7 which form the resistor series circuit 26 and the other end of the resistor series circuit 26, respectively. Consequently, the reference voltage production circuit 14 divides potential differences by the original reference voltages VRT, VB to VG, VRB produced by the original reference signal production circuit 12 further by means of the voltage dividing circuits R1 to R7 to produce the reference voltages V1 to V64 within the range of the original reference voltages VRT and VRB.

Since the reference voltages V1 to V64 are produced from the original reference voltages VRT, VB to VG, VRB in this manner, the numbers of resistors which form the voltage dividing circuits R1 to R7 of the reference voltage production circuit 14 are individually set, to predetermined numbers, and the original reference voltages VRT, VB to VG, VRB are divided so that a plurality of reference voltages V1 to V64 corresponding to gradations of the image data D1 can be outputted.

In the original reference signal production circuit 12, the values of the resistors which form the voltage dividing circuit 21 are set so that an image may be displayed with a desired gamma characteristic by means of the reference voltages V1 to V64 corresponding to the gradations of the image data D1 in this manner. Consequently, as seen from a curve L1 in FIG. 20 where the voltage VCOM is set to 5 V, a desired gamma characteristic can be assured by polygonal line approximation depending upon the setting of the original reference voltages VRT, VB to VG, VRB. Further, in the original reference signal production circuit 12, the original reference voltages VRT, VB to VG, VRB to be outputted from the voltage dividing circuit 21 can be changed over by a change of the wiring line pattern. Thus, as seen from a curve L2 shown for contrast with the characteristic indicated by the curve L1 in FIG. 20, for example, while the original reference voltages VRT and VRB which are potentials at the opposite ends are fixed, the remaining original reference voltages VB to VG can be varied within a range indicated by arrow marks to vary the gamma characteristic variously.

In the liquid crystal display apparatus 1 wherein the gamma characteristic can be changed over by the setting of the original reference signal production circuit 12 which produces the original reference voltages VRT, VB to VG, VRB in this manner, while the controller 7 including the original reference signal production circuit 12 is formed from a control IC, the horizontal drive circuit 4 is formed from a driver IC. Consequently, according to the liquid crystal display apparatus 1, products of different gamma characteristics can be produced by replacing only the control IC, and consequently, upon modification to the gamma characteristic, the period of time required for the modification can be reduced.

Incidentally, a display apparatus of the type described sometimes displays a plurality of different display objects at a time as in a case wherein, for example, as shown in FIG. 21, a natural picture G derived from a result of image pickup and menus M1 to M3 derived from operation and so forth are displayed at a time. As regards the natural picture G from among such display objects as described above, if the variation of the luminance level is set to a comparatively great amount on the black level side with respect to the variation of image data D1 as indicated by a curve L1 in FIG. 22, then a three-dimensional feeling can be assured at a portion at which the luminance level is low. Consequently, dark hair or the like can be displayed with a feeling of high quality and with a high degree of picture quality. However, as regards the menus M1 to M3, if the variation of the luminance level is set to a comparatively great amount on the black level side with respect to the variation of image data in this manner, then the menus M1 to M3 are displayed but in a dull image and in poor visibility. Therefore, it is demanded for the menus M1 to M3 to be displayed with a linear characteristic that the variation of the luminance level is substantially fixed with respect to the variation of the image data D1 as seen from a curve L2 in FIG. 22.

Consequently, where a plurality of different display objects are displayed at a time in this manner, it is necessary to change over the gamma characteristic set with the reference voltages V1 to V64 described hereinabove. Actually, however, where the conventional configuration of the original reference voltage production circuit 12 and the reference voltage production circuit 14 is employed, it is impossible to change over the gamma characteristic depending upon the display object in this manner. Consequently, the conventional display apparatus has a problem that, where a plurality of different display objects is displayed at a time, the display objects cannot be displayed individually with appropriate gamma characteristics.

Incidentally, one of possible solutions to the problem just described relies upon a process of image data. However, this solution has a problem that the process of image data is complicated and cumbersome.

SUMMARY OF THE INVENTION

It is an object of the present invention to provide a drive circuit for a flat display apparatus and a flat display apparatus wherein different display objects can be displayed at a time individually with appropriate gamma characteristics.

In order to attain the object described above, according to the present invention, a plurality of reference voltages are produced in different systems having different gamma characteristics, and one of the systems is selected in response to a selection signal. Then, the reference voltages of the selected system are selected in response to image data to set gradations of pixels. This makes it possible to display different display objects individually with appropriate gamma characteristics at a time.

More particularly, according to an aspect of the present invention, there is provided a drive circuit for a flat display apparatus wherein driving signals are produced by a digital to analog conversion process of image data and used to drive signal lines of a display section wherein pixels are arranged in a matrix, comprising an original reference voltage production circuit for producing a plurality of original reference voltages, a reference voltage production circuit including a resistor series circuit formed from a plurality of voltage dividing circuits connected in series and each including a plurality of resisters connected in series for receiving the original reference voltages at the opposite ends of and at nodes between the voltage dividing circuits of the resistor series circuit and outputting divided voltages by the voltage dividing circuits as a plurality of reference voltages, and a driving signal digital to analog conversion circuit for receiving the reference voltages as inputs thereto and selectively outputting the inputted reference voltages in accordance with the image data for the corresponding ones of the signal lines as the driving signals, the reference voltage production circuit producing the reference voltages in a plurality of systems having different gamma characteristics, and the driving signal digital to analog conversion circuit selecting the reference signals of one of the plural systems and selectively outputting the selected reference voltages in response to the image data.

With the drive circuit for a flat display apparatus, the gamma characteristic can be changed over by the changeover of the system of original reference voltages to set gradations of the pixels. Consequently, different display objects can be displayed individually with appropriate gamma characteristics at a time.

According to another aspect of the present invention, there is provided a flat display apparatus for displaying an image based on image data, comprising a display section including pixels arranged in a matrix, a horizontal drive circuit for producing driving signals from the image data and driving signal lines of the display section with the driving signals, and a body apparatus for outputting image data to the horizontal drive circuit, the body apparatus outputting selection signals for indicating selection of gamma characteristics to be used to display the image data to the horizontal drive circuit together with the image data, the horizontal drive circuit including an original reference voltage production circuit for producing a plurality of original reference voltages, a reference voltage production circuit including a resistor series circuit formed from a plurality of voltage dividing circuits connected in series and each including a plurality of resistors connected in series for receiving the original reference voltages at the opposite ends of and at nodes between the voltage dividing circuits of the resistor series circuit and outputting divided voltages by the voltage dividing circuits as a plurality reference voltages, and a driving signal digital to analog conversion circuit for receiving the reference voltages as inputs thereto and selectively outputting the inputted reference voltages in accordance with the image data for the corresponding ones of the signal lines as the driving signals, the reference voltage production circuit producing the reference voltages in a plurality of systems having different gamma characteristics, and the driving signal digital to analog conversion circuit selecting the reference signals of one of the plural systems and selectively outputting the selected reference voltages in response to the image data.

With the flat display apparatus, different display objects can be displayed individually with appropriate gamma characteristics at a time.

The above and other objects, features and advantages of the present invention will become apparent from the following description and the appended claims taken in conjunction with the accompanying drawings in which like parts or elements are denoted by like reference symbols.

DESCRIPTION OF THE PREFERRED EMBODIMENTS

1. Configuration of the Preferred Embodiment

Figure 1:
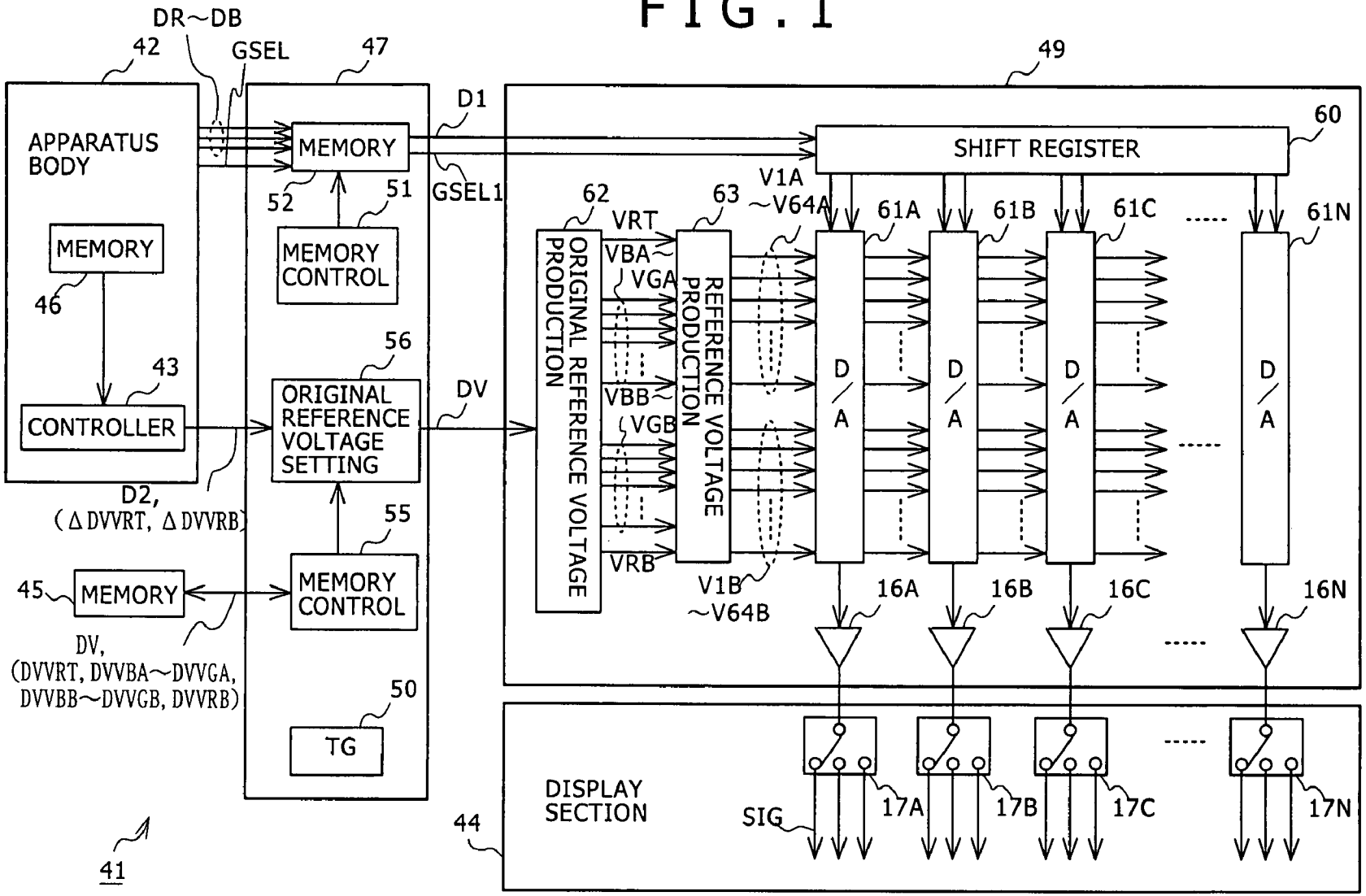
FIG. 1 is a block diagram showing a personal digital assistant according to a first embodiment of the present invention.
Figure 17:
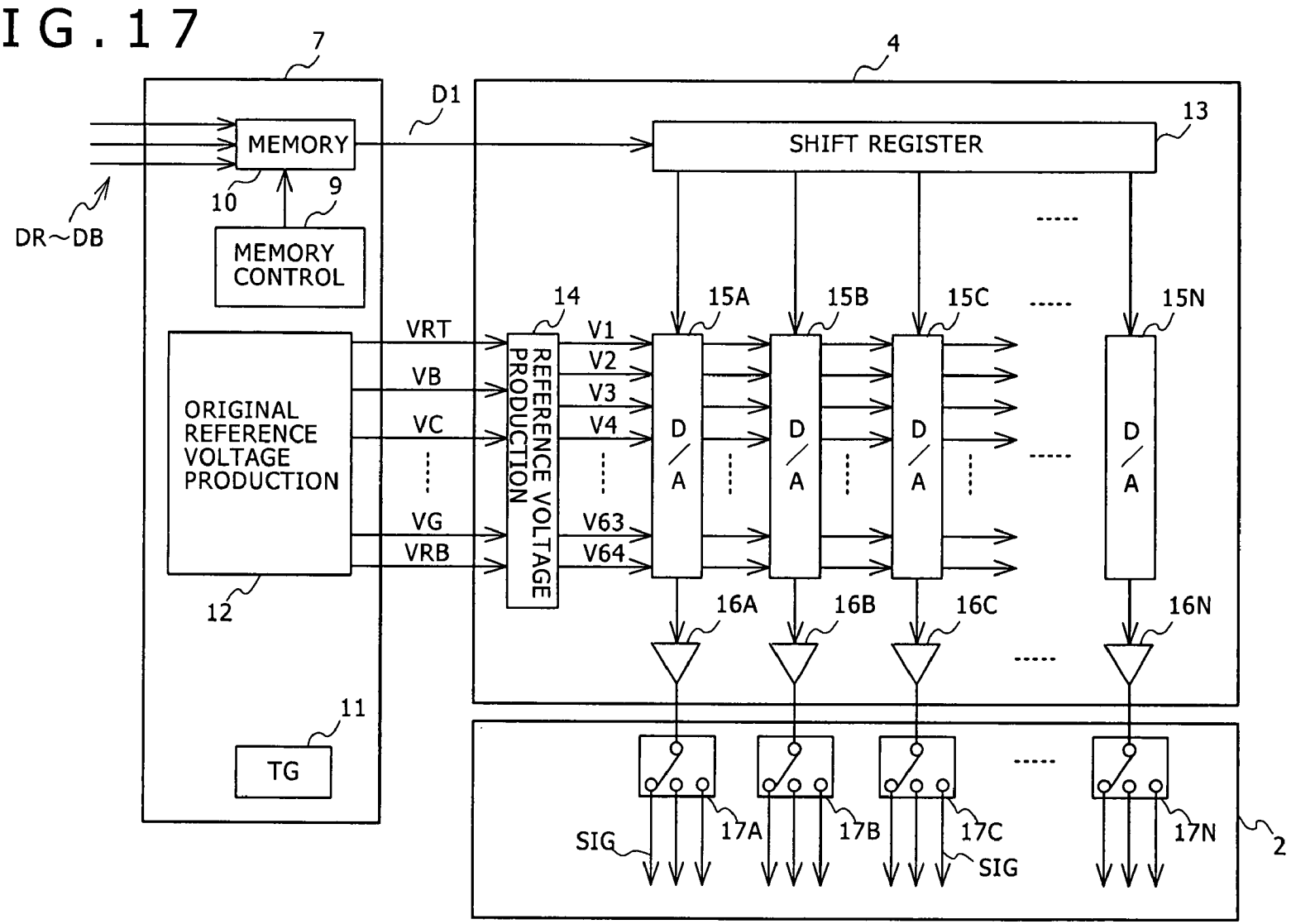
FIG. 17 is a block diagram showing a horizontal drive circuit of the liquid crystal display apparatus of FIG. 16 together with peripheral elements.

FIG. 1 shows in block diagram a PDA (Personal Digital Assistant) to which the present invention is applied. Referring to FIG. 1, the PDA 41 includes an apparatus body 42, a controller 43 serving as an arithmetic operation processing section for executing a predetermined processing procedure in response to an operation of an operation element, and a display section 44 for displaying various images thereon. It is to be noted that, in FIG. 1, elements like those of FIG. 17 are denoted by like reference characters and an overlapping description of them is omitted herein to avoid redundancy.

The display section 44 is a color image display panel wherein pixels constructed using an organic EL device are arranged in a matrix. The display section 44 includes gate lines connected to the pixels for successively selecting the pixels in a unit of a line under the control of a vertical drive circuit (not shown) and signal lines SIG that are driven to set the gradations of the individual pixels.

When the PDA 41 is shipped from a factory, the light emission characteristic of each color of the display section 44 constructed using an organic EL element is measured, and original reference voltage setting data DV for indicating the setting of original reference voltages VRT, VBA to VGA, VBB to VGB, VRB are recorded for each color into a memory 45. Consequently, the PDA 41 can use the original reference voltage setting data DV to correct dispersion in light emission characteristic for each color and a dispersion in light emission characteristic among products. Therefore, the PDA 41 can display a display image with a correct white balance and correct color reproducibility.

In the present embodiment, the original reference voltage VRT which exhibits the highest voltage and the original reference voltage VRB which exhibits the lowest voltage from among the original reference voltages VRT, VBA to VGA, VBB to VGB, VRB that are set with the original reference voltage setting data DV are original reference voltages corresponding to the gradations of the black level and the white level, respectively. Thus, in the following description, the two original reference voltages VRT and VRB are referred to suitably as black level original reference voltage VRT and white level original reference voltage VRB, respectively.

The original reference voltage setting data DV includes black level original reference voltage setting data DVVRT and white level original reference voltage setting data DVVRB corresponding to the black level original reference voltage VRT and the white level original reference voltage VRB, respectively. The original reference voltage setting data DV further include original reference voltage setting data DVVBA to DVVGA and DVVBB to DVVGB for setting two systems of reference voltage voltages VBA to VGA and VBB to VGB within the ranges of the black level original reference voltage VRT and the white level original reference voltage VRB set with the black level original reference voltage setting data DVVRT and the white level original reference voltage setting data DVVRB, respectively. The two systems of original reference voltage setting data DVVBA to DVVGA and DVVBB to DVVGB are the original reference voltage setting data DV to be used for the setting of gamma characteristics for a natural picture and a menu, respectively. In the present embodiment, the two systems of original reference voltage setting data DVVBA to DVVGA and DVVBB to DVVGB are changed over to perform changeover between the reference voltage voltages VBA to VGA and VBB to VGB so that a natural picture and a menu can be displayed individually with appropriate gamma characteristics. Consequently, different display objects to be displayed at a time can be displayed with individually appropriate gamma characteristics.

Consequently, the memory 45 stores the black level original reference voltage setting data DVVRT, the white level original reference voltage setting data DVVRB, and the other original reference voltage setting data DVVBA to DVVGA and DVVBB to DVVGB.

Figure 2:
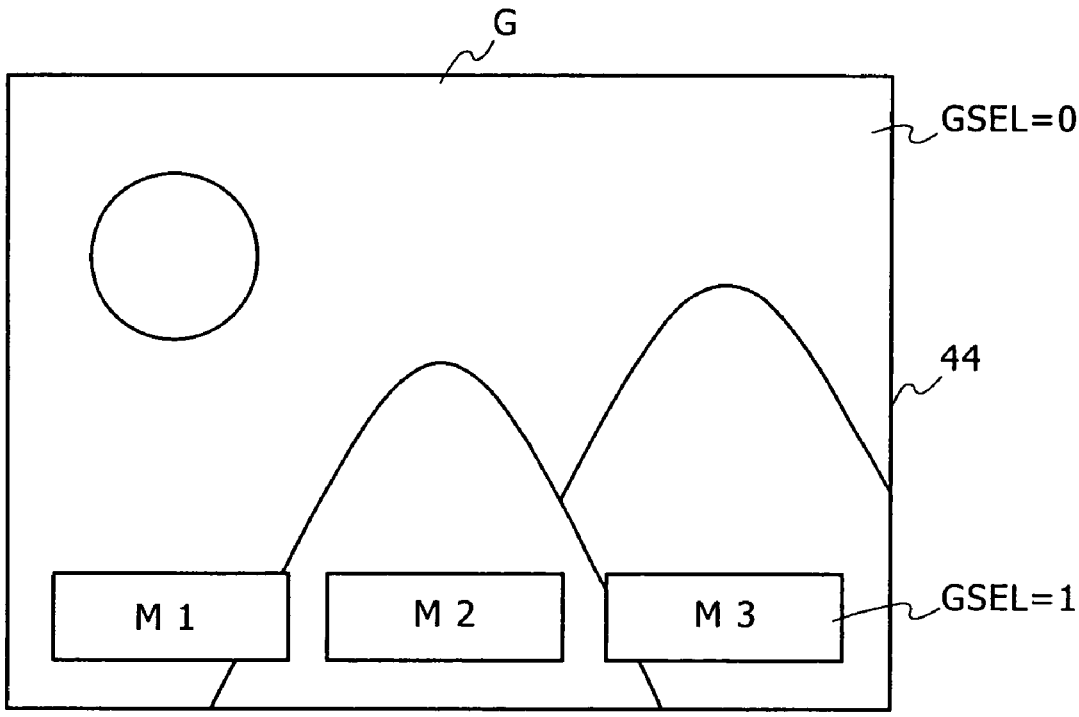
FIG. 2 is a schematic plan view showing a display screen of the personal digital assistant of FIG. 1.
Figures 3A, 3B, 3C, 3D, 3E, 3F, 3G:
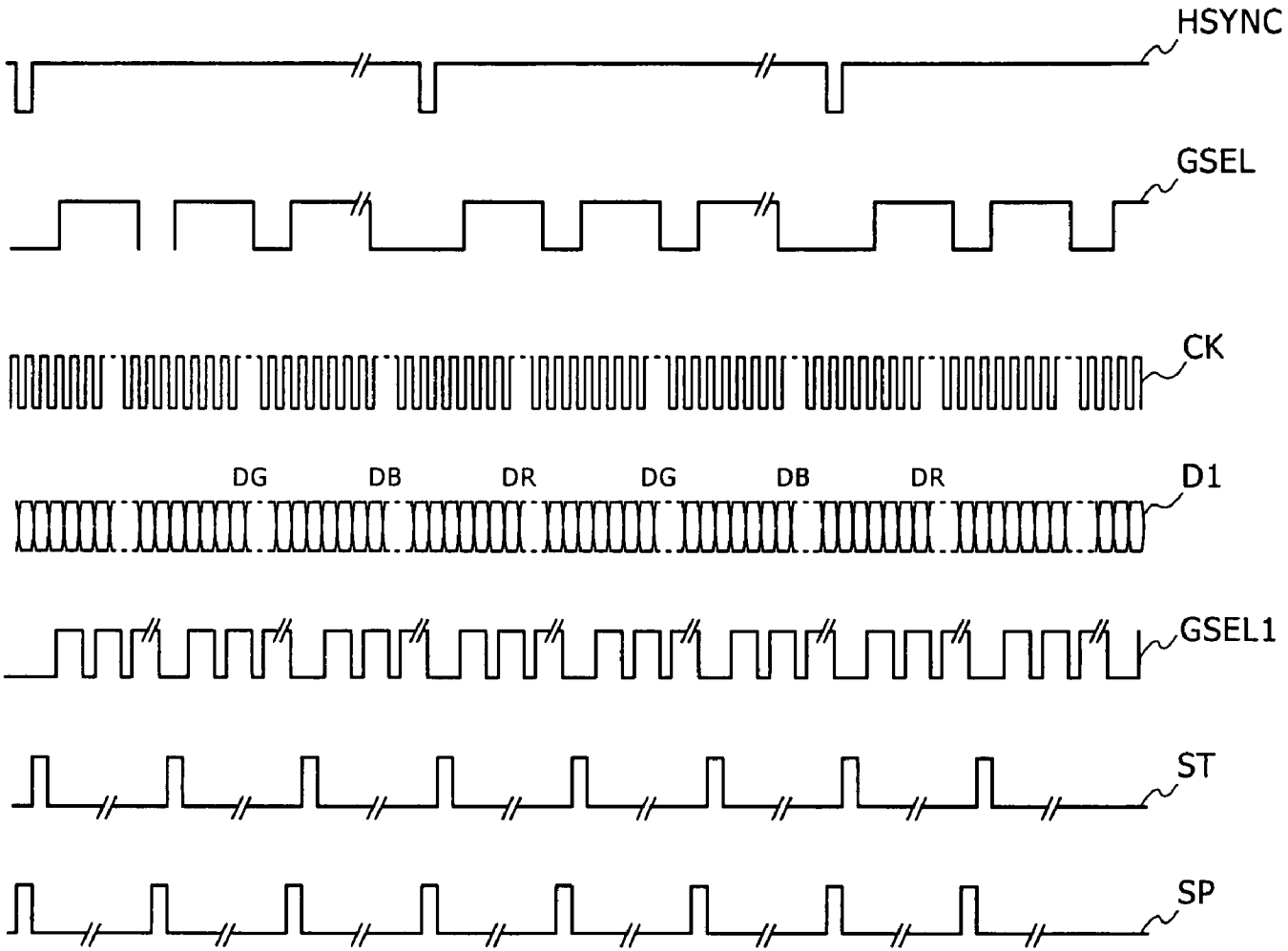
FIGS. 3A to 3G are time charts illustrating operation of the personal digital assistant of FIG. 1.

Corresponding to this, the PDA 41 outputs a gamma changeover signal GSEL for indicating changeover of the gamma characteristic between the natural picture G and the menus M1 to M3 in synchronism with the image data DR, DG, dB outputted from the apparatus body 42 under the control of the controller 43, as seen in FIG. 2. It is to be noted that, in the example illustrated in FIG. 2, the gamma changeover signal GSEL is set to a value 0 for the natural picture G and to another value 1 for the menus M1 to M3.

Further, the PDA 41 is configured such that it can cope with a secular change in light emission characteristic in accordance with a liking of a user and that it can execute a predetermined processing procedure by means of the controller 43 to adjust the white balance, the black level and the white level of the display section 44. A result of the adjustment is recorded into and held by a memory 46, and the display of the display section 44 is set based on the result of the adjustment. In the PDA 41, correction data D2 for the black level original reference voltage setting data DVVRT and the white level original reference voltage setting data DVVRB from among the original reference voltage setting data DVVRT, DVVBA to DVVGA, DVVBB to DVVGB, DVVRB recorded in the memory 45 and representing data upon shipment of the PDA 41 from a factory are recorded and retained in the form of difference data ΔDVVRT and ΔDVVRB corresponding to the original reference voltage setting data DVVRT and DVVRB into and by the memory 46 for each color. The correction data D2 recorded in the memory 46 are outputted to a controller 47 at a timing based on processing of the controller 47. Consequently, the PDA 41 records and retains such a result of adjustment, such as white balance adjustment as described above, and sets the display of the display section 44 based on the result of the adjustment.

The controller 47 is formed from an integrated circuit, and time division multiplexes image data DR, DG, DB of the different colors outputted from the apparatus body 42 in a unit of a line to produce a single system of image data D1 and outputs the image data D1 of one system together with a gamma changeover signal GSEL1. Further, the controller 47 corrects the original reference voltage setting data DV with the correction data D2 outputted from the controller 43 of the apparatus body 42 and outputs resulting data to a horizontal drive circuit 49.

Figures 18A, 18B, 18C, 18D, 18E, 18F:
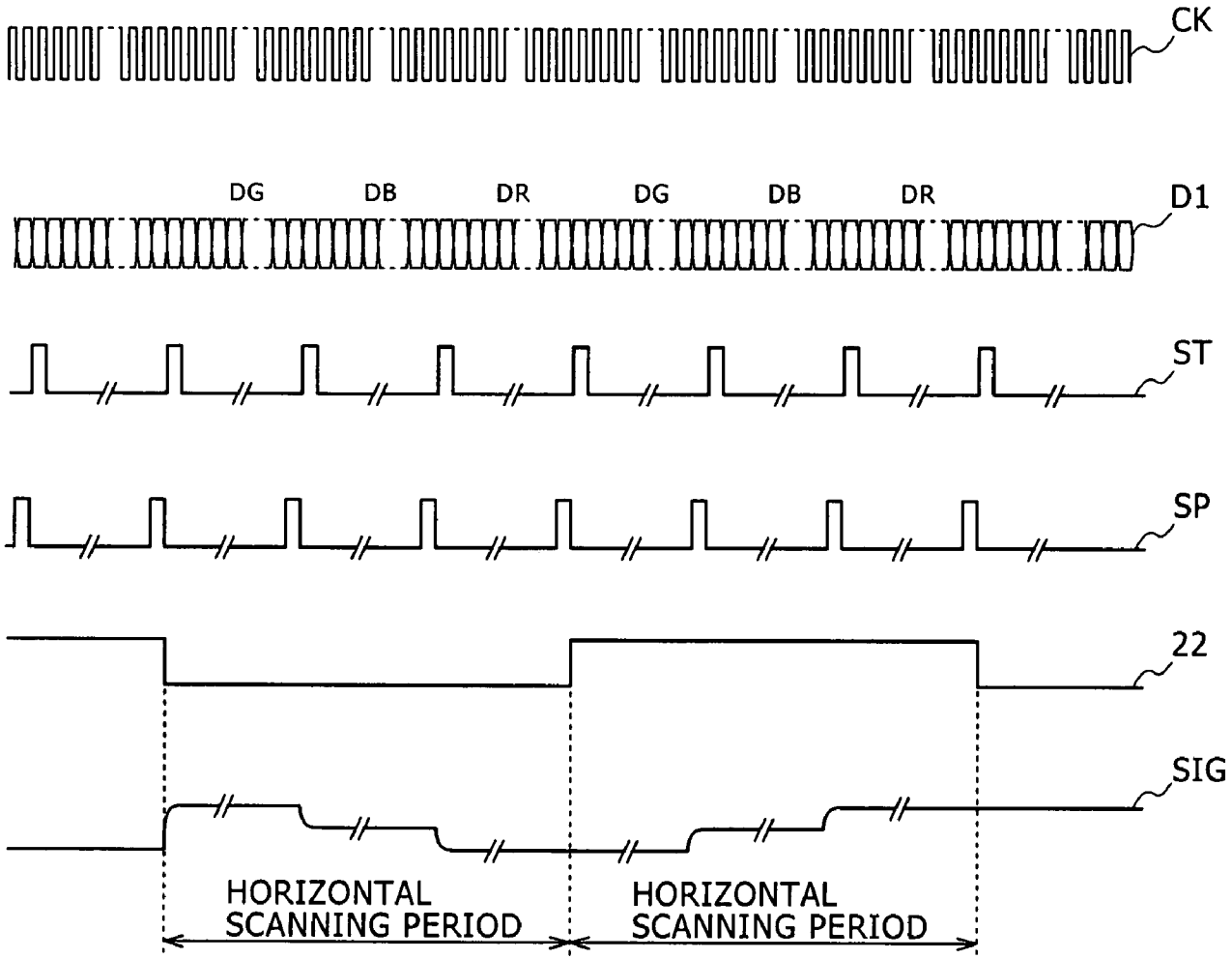
FIGS. 18A to 18F are time charts illustrating operation of the horizontal drive circuit shown in FIG. 16.

In particular, in the controller 47, a timing generator (TG) 50 produces and outputs various timing signals (FIGS. 3A, 3C, 3F and 3G) synchronized with the image data D1 and DR to DB as seen in FIGS. 3A to 3G, in contrast with FIG. 18. A memory control circuit 51 controls the operation of a memory 52 with reference to the timing signals. The memory 52 successively stores and outputs the image data DR to DB outputted from the apparatus body 42, thereby to time division multiplex the image data DR, DG, DB in a unit of a line to produce image data D1 (FIG. 3D) and output the image data D1. At this time, the memory 52 receives the gamma changeover signal GSEL (FIG. 3B) as an input thereto together with the image data DR to DB and outputs the inputted gamma changeover signal GSEL as the gamma changeover signal GSEL1 (FIG. 3E) at a timing corresponding to the image data D1.

A memory control circuit 55 controls the operation of the memory 45 to read out original reference voltage setting data DV from the memory 45 within a horizontal scanning period and outputs the original reference voltage setting data DV to an original reference voltage setting circuit 56.

Figure 4:
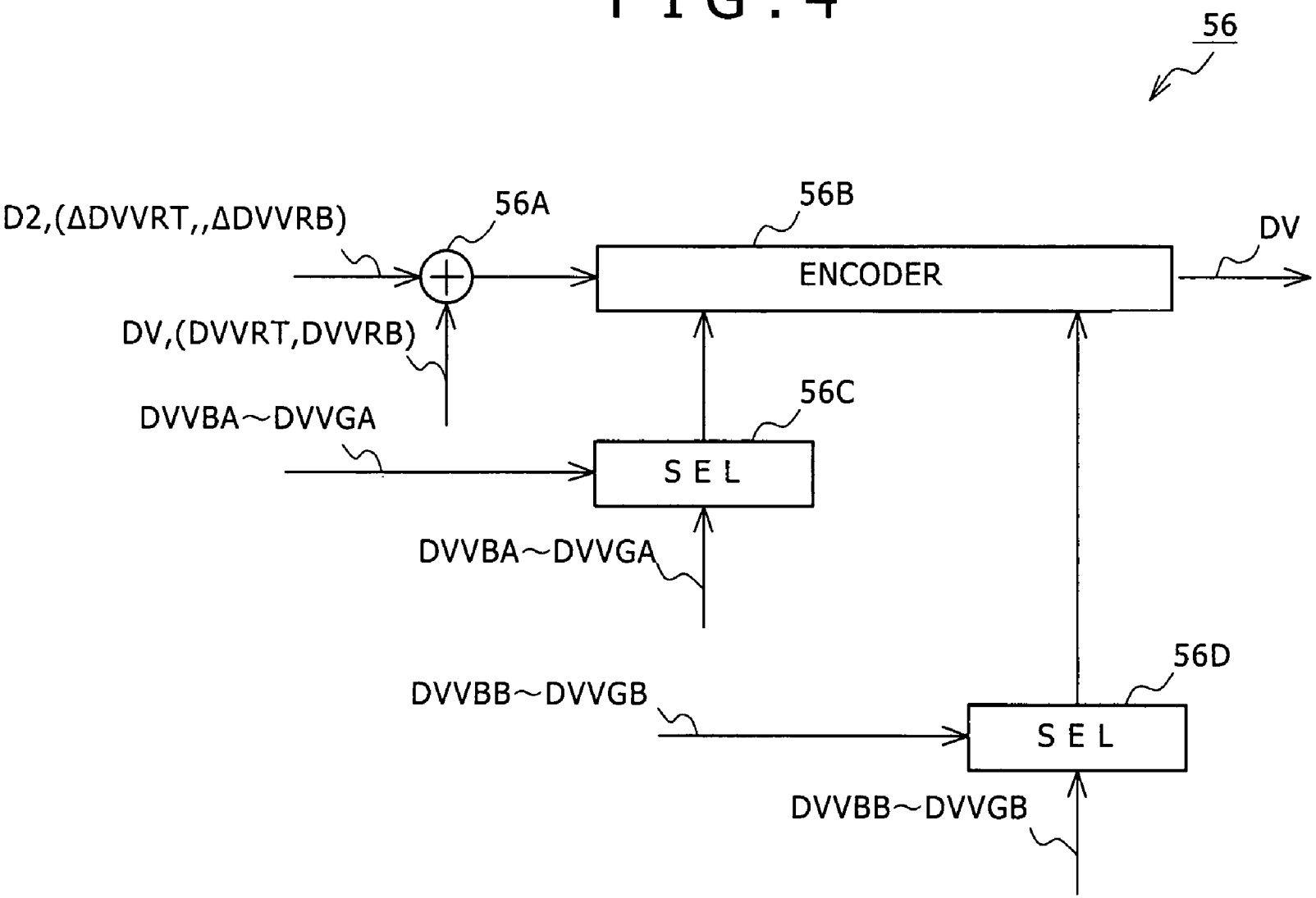
FIG. 4 is a block diagram showing a reference voltage setting circuit of the personal digital assistant of FIG. 1.

The original reference voltage setting circuit 56 corrects and outputs the original reference voltage setting data DV outputted from the memory control circuit 55 with the correction data D2 outputted from the controller 43 of the apparatus body 42. In particular, as seen from FIG. 4, the original reference voltage setting circuit 56 inputs, from among the original reference voltage setting data DV (DVVRT, DVVBA to DVVGA, DVVBB to DVVGB, DVVRB) inputted thereto through the memory control circuit 55, the black level original reference voltage setting data DVVRT and the white level original reference voltage setting data DVVRB to an addition circuit 56A. The addition circuit 56A adds the corresponding correction data D2 (ΔDVVRT and ΔDVVRB) outputted from the apparatus body 42 to the original reference voltage setting data DVVRT and DVVRB, thereby to correct the black level original reference voltage setting data DVVRT and the white level original reference voltage setting data DVVRB. Further, the black level original reference voltage setting data DVVRT and the white level original reference voltage setting data DVVRB corrected in this manner are inputted to an encoder 56B, and also the remaining original reference voltage setting data DVVBA to DVVGA and DVVBB to DVVGB are inputted to the encoder 56B through selectors (SEL) 56C and 56D, and the encoder 56B converts the inputted original reference voltage setting data DVVRT, DVVBA to DVVGA, DVVBB to DVVGB, DVVRB into serial data and outputs the serial data. It is to be noted that the original reference voltage setting circuit 56 can output, depending upon setting of the selectors 56C and 56D, original reference voltage setting data outputted separately from the apparatus body 42 in place of the original reference voltage setting data DVVBA to DVVGA and DVVBB to DVVGB outputted from the memory control circuit 55 in this manner.

In the series of processes described above, the original reference voltage setting circuit 56 produces and outputs original reference voltage setting data DV corresponding to the driving of the signal lines SIG of the horizontal drive circuit 49. In the present embodiment, however, the display section 44 is configured such that pixels of red, green and blue which are contiguous in a horizontal direction are set as one group and the pixels of one group are driven time divisionally with a single driving signal so that the original reference voltage setting circuit 56 can switchably output the original reference voltage setting data DV for image data DR, DG, DB of red, green and blue within a period of one horizontal scanning period.

The horizontal drive circuit 49 is formed from an integrated circuit separate from that of the controller 47 and distributes, together with the gamma changeover signal GSEL1, image data D1 outputted from the controller 47 into different pixel groups, each including red, green and blue pixels contiguous to each other in the horizontal direction, by means of a shift register 60 and then converts the distributed data from digital into analog data by means of the digital to analog conversion circuits 61A to 61N each formed from a selector. Further, driving signals which depend upon results of the digital to analog process by the digital to analog conversion circuits 61A to 61N are amplified by the amplification circuits 16A to 16N and outputted to the display section 44. Consequently, the display section 44 distributes the output signals of the digital to analog conversion circuits 61A to 61N to the signal lines SIG by means of the selectors 17A to 17N, respectively.

In the process just described, the horizontal drive circuit 49 selects, from between the two systems of reference voltages V1A to V64A and V1B to V64B produced by the original reference voltage production circuit 62 and the reference voltage production circuit 63, one of the systems, that is, the reference voltages VIA to V64A or V1B to V64B, in response to the gamma changeover signal GSEL1. Then, the reference voltages VIA to V64A or V1B to V64B are selected in response to the image data D1 to perform a digital to analog conversion process for the image data D1. Consequently, in the present embodiment, the gamma characteristic is changed over between the natural picture G and the menus M1 to M3 to produce driving signals, and the gradations of the pixels of the display section 44 are set with the driving signals. Consequently, even when the natural picture G and the menus M1 to M3 are displayed at a time, the natural picture G and the menus M1 to M3 can be displayed individually with optimum gamma characteristics.

In particular, in the horizontal drive circuit 49, the shift register 60 successively receives and stores the image data D1 outputted from the controller 47 and the gamma changeover signal GSEL1 and outputs the image data D1 and the gamma changeover signals GSEL1 stored at predetermined timings to the digital to analog conversion circuits 61A to 61N, thereby to output the image data D1 for one line collectively for the individual colors simultaneously and parallelly to the digital to analog conversion circuits 61A to 61N. Further, the shift register 60 outputs the corresponding gamma changeover signals GSEL1 to the digital to analog conversion circuits 61A to 61N.

The digital to analog conversion circuits 61A to 61N receive the two systems of reference voltages V1A to V64A and V1B to V64B produced by the reference voltage production circuit 63 as inputs thereto and select the two systems of reference voltages V1A to V64A and V1B to V64B in response to the gamma changeover signals GSEL1 outputted thereto from the shift register 60. The gamma changeover signals GSEL1 used for the selection are selected in response to the image data D1 outputted from the shift register 60. Consequently, a digital to analog conversion process is applied to the image data D1 with the gamma characteristics in accordance with the natural picture G and the menus M1 to M3 to produce driving signals.

Figures 5A, 5B, 5C, 5D, 5E, 5F:
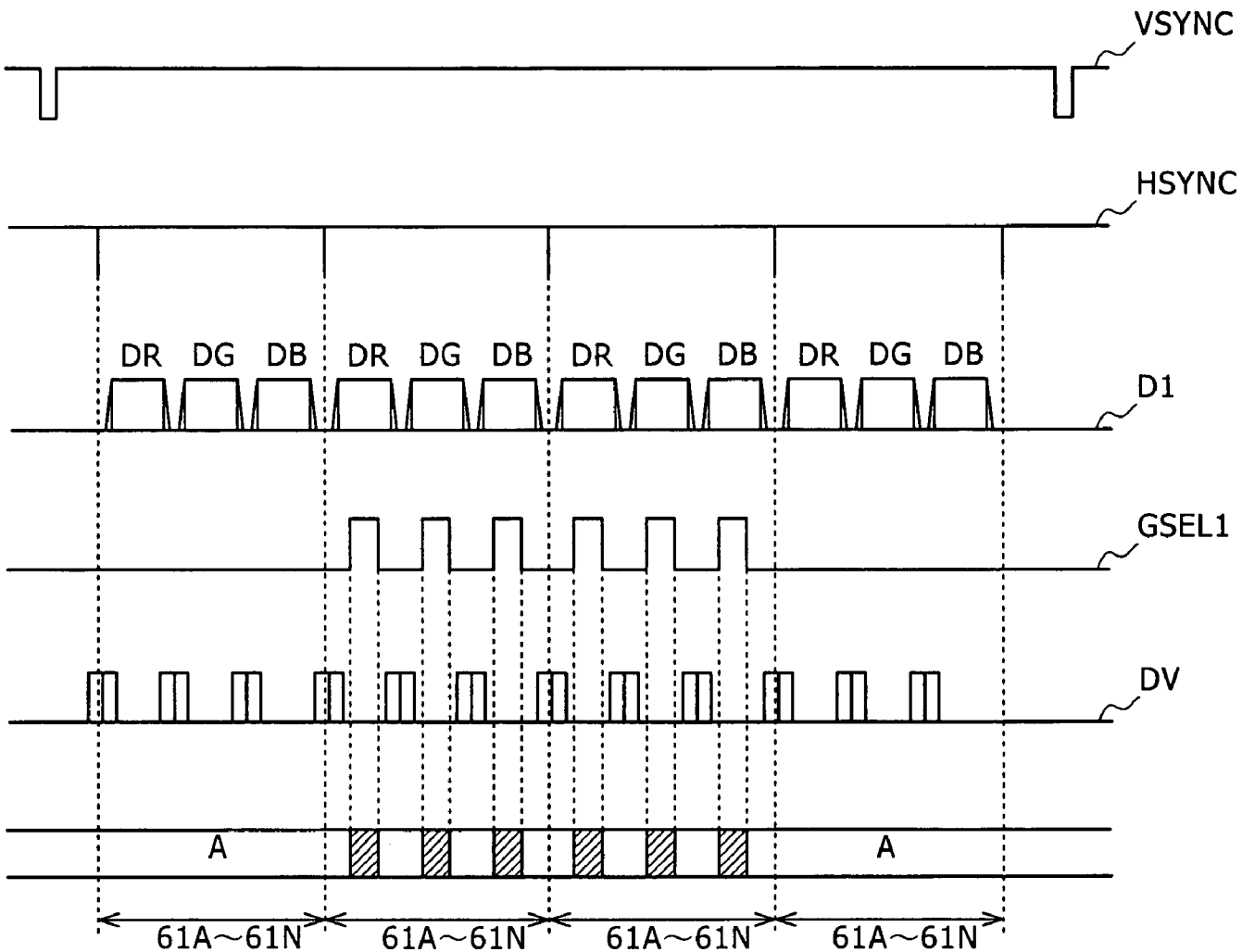
FIGS. 5A to 5F are time charts illustrating changeover of the gamma characteristic by the personal digital assistant of FIG. 1.

As seen from FIGS. 5C to 5F shown with reference to a vertical synchronizing signal Vsync and a horizontal synchronizing signal Hsync (FIGS. 5A and 5B), image data DR to DB (FIG. 5C) of red, green and blue are multiplexed and inputted as the image data D1 (FIG. 5C) to the horizontal drive circuit 49 together with the gamma changeover signal GSEL1 (FIG. 5D). Thus, the image data DR to DB are converted into driving signals with the two different gamma characteristics based on the gamma setting data DV (FIG. 5E) by the digital to analog conversion circuits 61A to 61N (FIG. 5F) and used to drive the signal lines SIG. It is to be noted that, in FIG. 5F, the gamma characteristic for the natural picture G is indicated by reference character A, and the gamma characteristic for the menus M1 to M3 is indicated by slanting lines.

In the present embodiment, the horizontal drive circuit 49 produces the reference voltages V1A to V64A and V1B to V64B relating to such two systems of gamma characteristics with reference to the black level original reference voltage VRT and the white level original reference voltage VRB produced with the black level original reference voltage setting data DVVRT and the white level original reference voltage setting data DVVRB, respectively. Consequently, the adjustment operation for each product and for each color can be simplified, and besides, the setting operation of gamma characteristics can be simplified.

Figure 6:
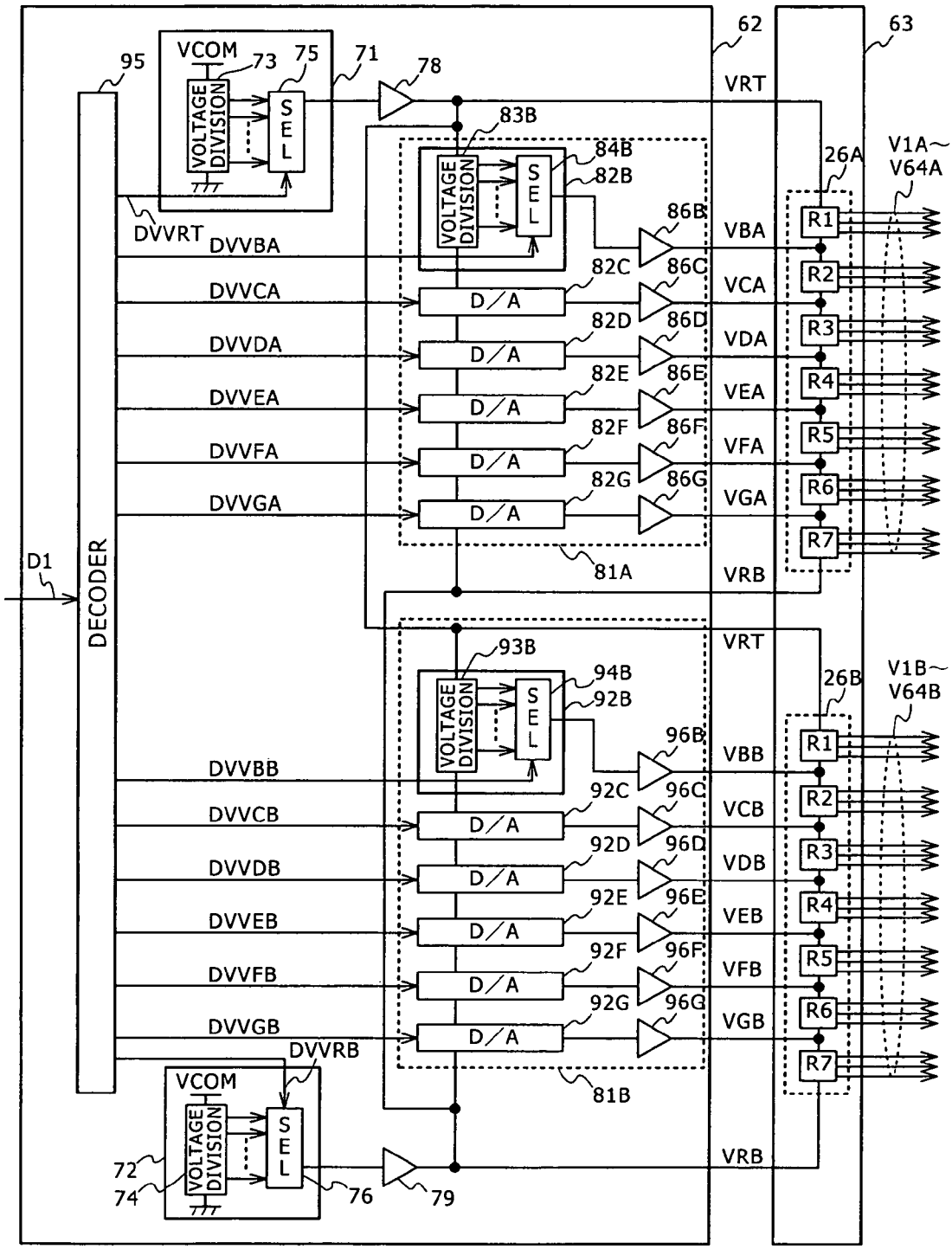
FIG. 6 is a block diagram showing an original reference voltage production circuit and the reference voltage production circuit of the personal digital assistant of FIG. 1.
Figure 19:
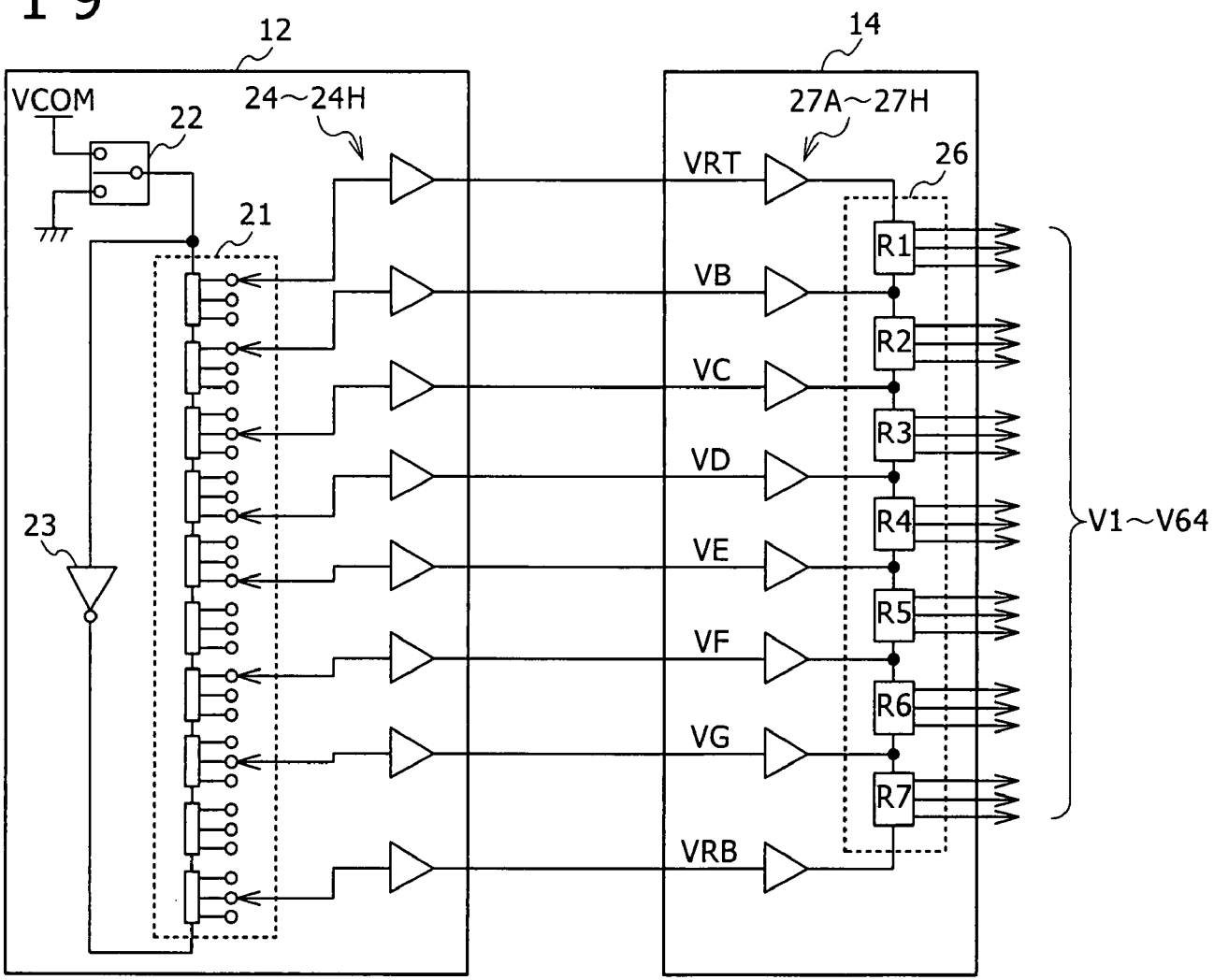
FIG. 19 is a block diagram showing an original reference voltage production circuit and a reference voltage production circuit in a horizontal drive circuit and a controller shown in FIG. 16.
Figure 20:
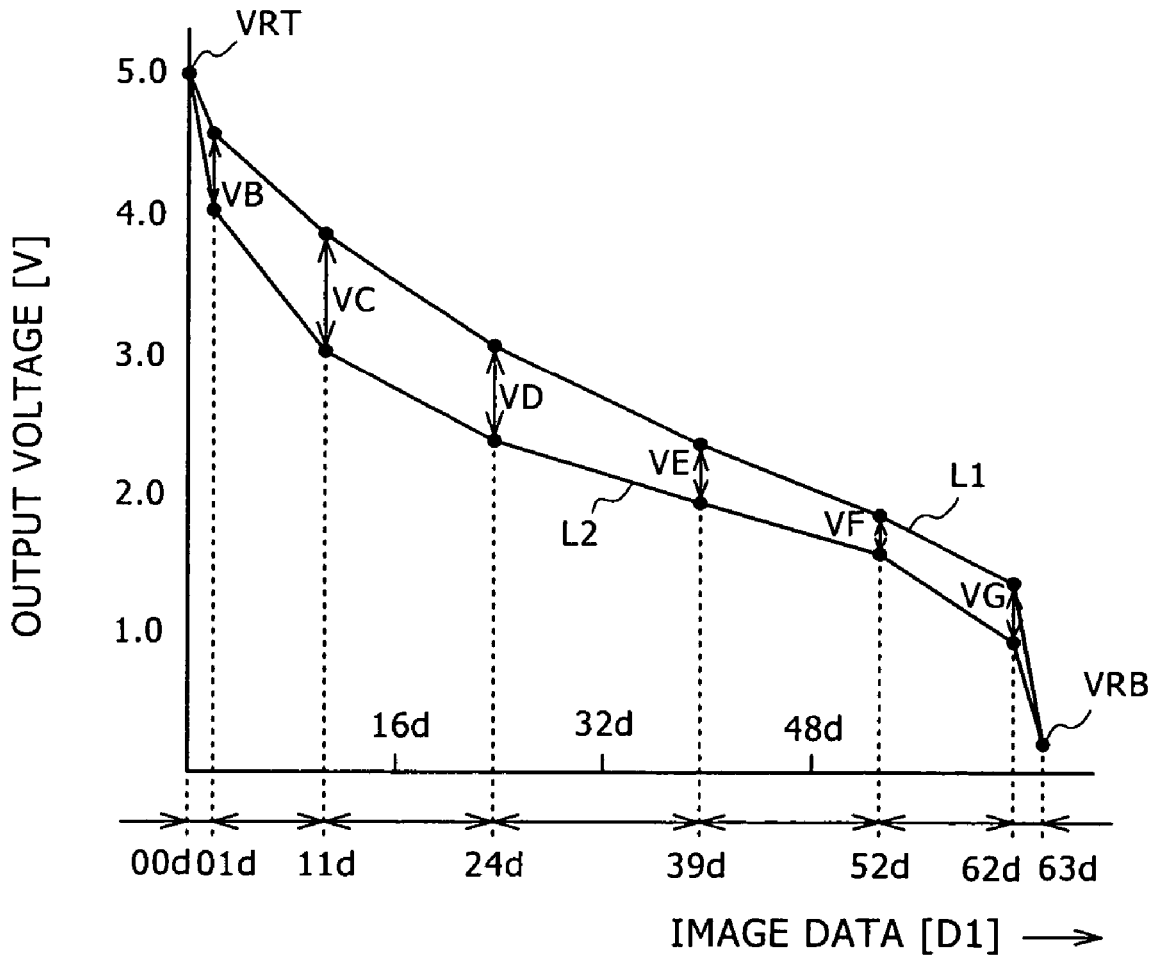
FIG. 20 is a characteristic diagram illustrating a gamma characteristic of the liquid crystal display apparatus of FIG. 16.
Figure 21:
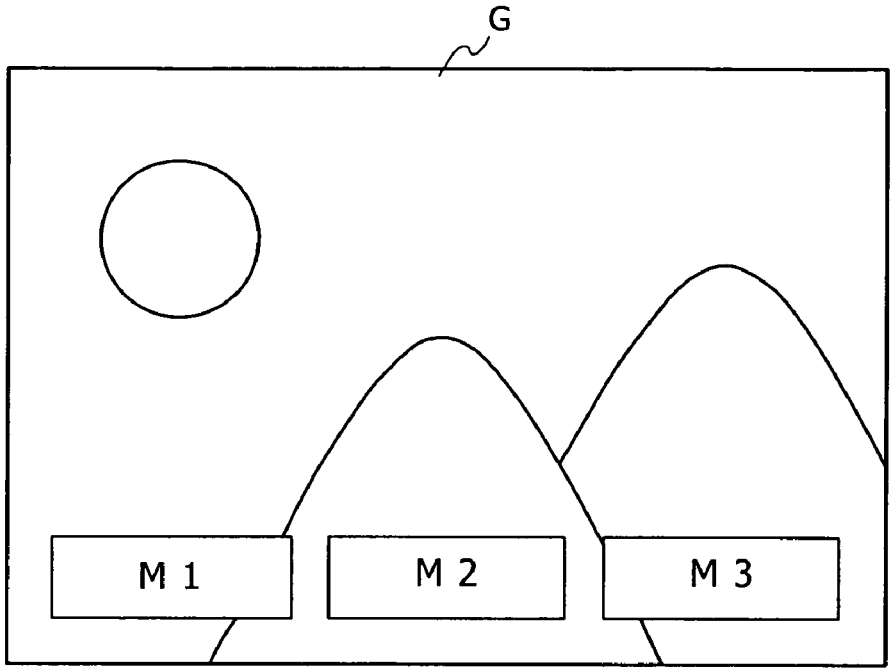
FIG. 21 is a schematic plan view showing an example of a display screen which includes a natural picture and a menu.
Figure 22:
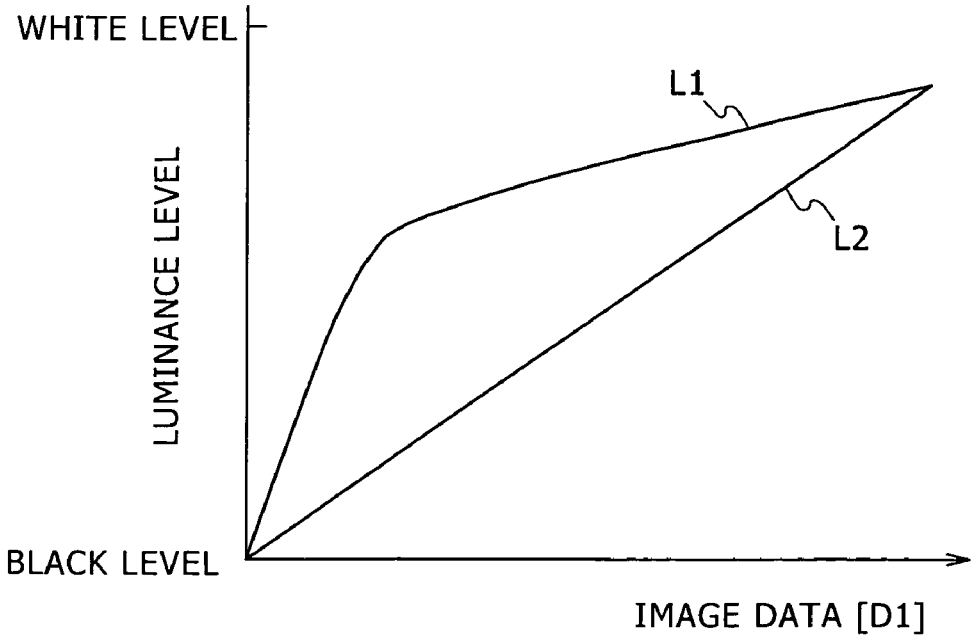
FIG. 22 is a characteristic diagram illustrating an example of gamma characteristics demanded for a natural picture and a menu.

FIG. 6 shows in a block diagram the original reference voltage production circuit 62 and the reference voltage production circuit 63. The reference voltage production circuit 63 is different from the reference voltage production circuit 14 described hereinabove with reference to FIG. 19 in that the amplification circuits 27A to 27H are omitted and, corresponding to the two systems of reference voltages V1A to V64A and V1B to V64B, two systems of resistor series circuits 26A and 26B, in each of which resistors R1 to R7 are connected in series. are provided and each of the resistor series circuits 26A and 26B produces the system of reference voltages V1A to V64A or V1B to V64B with the original reference voltages VRT, VBA to VGA, VRB or VRT, VBB to VGB, VRB.

The original reference voltage production circuit 62 produces the black level original reference voltage VRT and the white level original reference voltage VRB in response to the black and white level original reference voltage setting data DVVRT and DVVRB by means of digital to analog conversion circuits (D/A), 71 and 72 respectively. In particular, each of the digital to analog conversion circuits 71 and 72 in the original reference voltage production circuit 62 divides a reference voltage production voltage VCOM by means of a voltage dividing circuit 73 or 74 to produce a plurality of candidate voltages for original reference voltages. The voltage dividing circuits 73 and 74 are each formed from a series circuit of a plurality of resistors having an equal resistance value, and they divide the reference voltage production voltage VCOM with a resolution corresponding to the number of bits of the original reference voltage setting data DV and output the divided voltages. In the present embodiment, the original reference voltage setting data DV are formed as 6-bit data, and the reference voltage production voltage VCOM is set to 5 V. Consequently, the voltage dividing circuits 73 and 74 output 64 different candidate voltages that are successively different in a unit of approximately 80 mV (≈5 [V]/64).

Selectors 75 and 76 in the digital to analog conversion circuits 71 and 72 select the 64 candidate voltages outputted from the voltage dividing circuits 73 and 74 in response to the black level original reference voltage setting data DVVRT and the white level original reference voltage setting data DVVRB to produce a black level original reference voltage VRT and a white level original reference voltage VRB, respectively. The selectors 75 and 76 output the black level original reference voltage VRT and the white level original reference voltage VRB produced in this manner through amplification circuits 78 and 79, respectively.

In the original reference voltage production circuit 62, gamma setting circuits 81A and 81B produce original reference voltages VBA to VGA and VBB to VGB from the different systems of original reference voltage setting data DVVBA to DVVGA and DVVBB to DVVGB with reference to the black level original reference voltage VRT and the white level original reference voltage VRB, respectively. Then, the gamma setting circuits 81A and 81B set gamma characteristics through linear approximation wherein the black level original reference voltage VRT and the white level original reference voltage VRB are individually set as the opposite end voltages.

In particular, in the gamma setting circuit 81A, the digital to analog conversion circuits 82B to 82G produce a plurality of candidate voltages for the original reference voltages VBA to VGA by resistor voltage division by means of voltage dividing circuits 83B to 83G, select the candidate voltages in response to the original reference voltage setting data DVVBA to DVVGA by means of selectors 84B to 84G to produce original reference voltages VBA to VGA and output the produced original reference voltages VBA to VGA, respectively, similarly to the digital to analog conversion circuits 71 and 72. The digital to analog conversion circuits 82B to 82G are connected to the black level original reference voltage VRT and the white level original reference voltage VRB provided by the digital to analog conversion circuits 71 and 72 such that the voltage dividing circuits 83B to 83G thereof used to produce candidate voltages for the original reference voltages VBA to VGA are connected in series between the digital to analog conversion circuits 82B to 82G.

The gamma setting circuit 81A outputs the original reference voltages VBA to VGA outputted from the digital to analog conversion circuits 82B to 82G to one system of the resistor series circuit 26A of the reference voltage production circuit 63 together with the black level original reference voltage VRT and the white level original reference voltage VRB through amplification circuits 86B to 86G, respectively.

Consequently, in the case of the original reference voltages VBA to VGA of one system except the black level original reference voltage VRT and the white level original reference voltage VRB from among the original reference voltages VRT, VBA to VGA, VBB to VGB, VRB, it is difficult to vary the voltage exceeding the ranges of the candidate voltages outputted from the voltage dividing circuits 83B to 83G connected in series to each other. Therefore, as seen from FIG. 8 in comparison with FIG. 7, even if the original reference voltage setting data DV are set in error because of the invasion of noise, outputting of a driving signal of an extreme gamma characteristic can be prevented, and significant deterioration of the picture quality by noise can be prevented.

Figure 7:
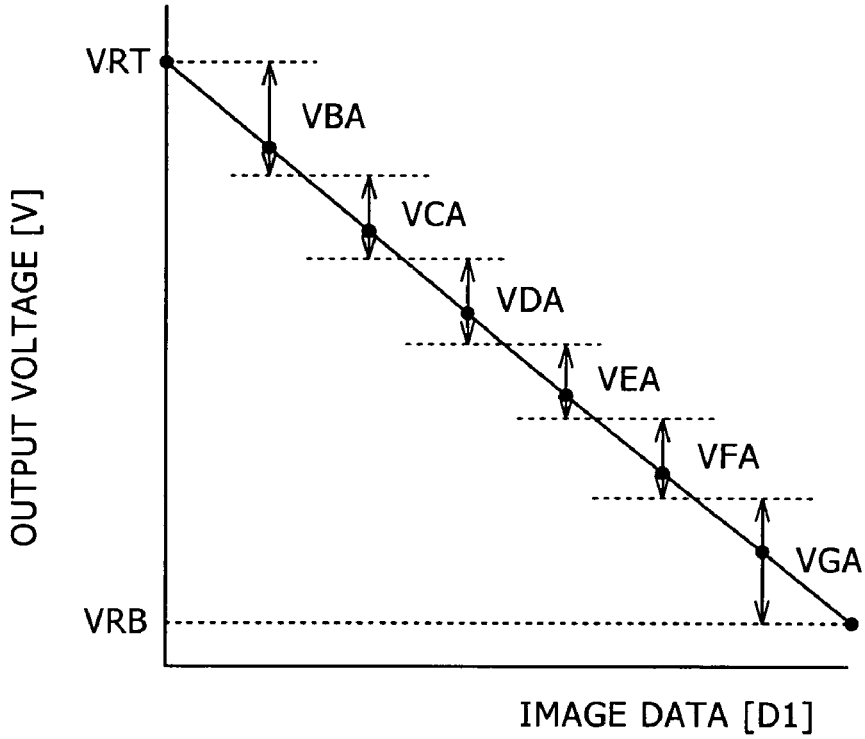
FIG. 7 is a characteristic diagram illustrating an original reference voltage produced by the original reference voltage production circuit shown in FIG. 6.
Figure 8:
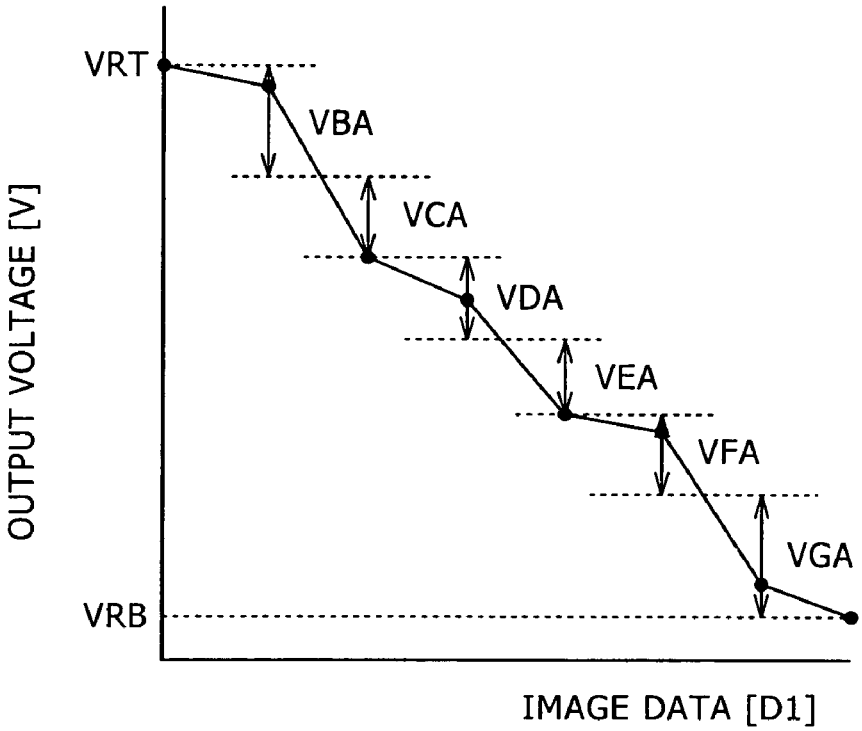
FIG. 8 is a characteristic diagram illustrating an influence of noise in the personal digital assistant of FIG. 1.
Figure 9:
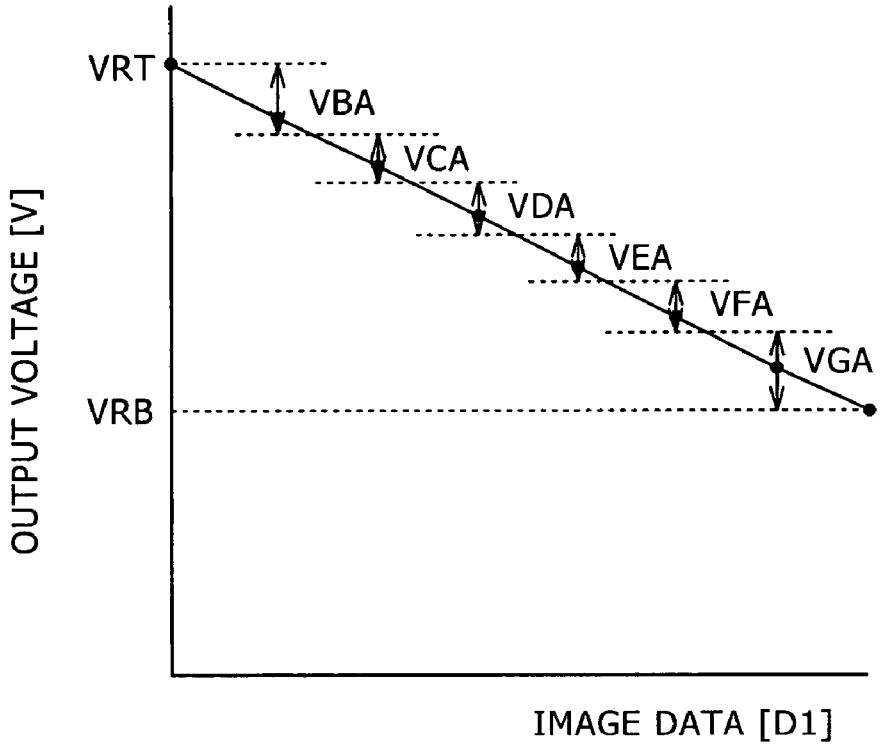
FIG. 9 is a characteristic diagram illustrating dynamic range adjustment by the personal digital assistant of FIG. 1.

Further, since the opposite ends of the voltage dividing circuits 83B to 83G connected in series to each other in this manner are connected to the black level original reference voltage VRT and the white level original reference voltage VRB, if the original reference voltages VRT and VRB are varied by black level adjustment or dynamic range adjustment in order to correct a dispersion in light emission characteristic among the colors and a dispersion in light emission characteristic among products, then also the original reference voltages VBA to VGA vary following up the variation of the original reference voltages VRT and VRB in accordance with the resistor voltage dividing ratio by the voltage dividing circuits 83B to 83G connected in series to each other, as seen from FIG. 9 shown in comparison with FIG. 7. Consequently, a process of resetting the original reference voltages VBA to VGA can be omitted, and as a result, a calculation process relating to the remaining digital to analog conversion circuits can be omitted and the adjustment operation can be simplified.

In the gamma setting circuit 81B, digital to analog conversion circuits 92B to 92G produce a plurality of candidate voltages for the original reference voltages VBB to VGB by resistor voltage division by means of voltage dividing circuits 93B to 93G, select the candidate voltages in response to the original reference voltage setting data DVVBB to DVVGB by means of selectors 94B to 94G to produce original reference voltages VBB to VGB and output the produced original reference voltages VBB to VGB, respectively, similarly to the gamma setting circuit 81A. The digital to analog conversion circuits 92B to 92G are connected to the black level original reference voltage VRT and the white level original reference voltage VRB provided by the digital to analog conversion circuits 71 and 72 such that the voltage dividing circuits 93B to 93G thereof used to produce candidate voltages for the original reference voltages VBB to VGB are connected in series between the digital to analog conversion circuits 92B to 92G.

The gamma setting circuit 81B outputs the original reference voltages VBB to VGB outputted from the digital to analog conversion circuits 92B to 92G to one system of the resistor series circuit 26B of the reference voltage production circuit 63 together with the black level original reference voltage VRT and the white level original reference voltage VRB through amplification circuits 96B to 96G, respectively.

Consequently, in the present embodiment, also with regard to the reference voltages V1B to V64B for the menu side, the influence of noise can be reduced and the adjustment operation can be simplified.

Further, since the two systems of the reference voltages V1A to V64A and V1B to V64B are produced with reference to the black level original reference voltage VRT and the white level original reference voltage VRB in this manner, it is possible to adjust the black level and the white level for each color and for each product and set the original reference voltage setting data DVVBA to DVVGA and DVVBB to DVVGB within the range of the original reference voltage VRT and the original reference voltage VRB by the adjustment to implement different gamma characteristics from each other. Consequently, the adjustment operation for the black level and the white level for each gamma characteristic can be omitted and the adjustment operation can be simplified as much.

Figure 10:
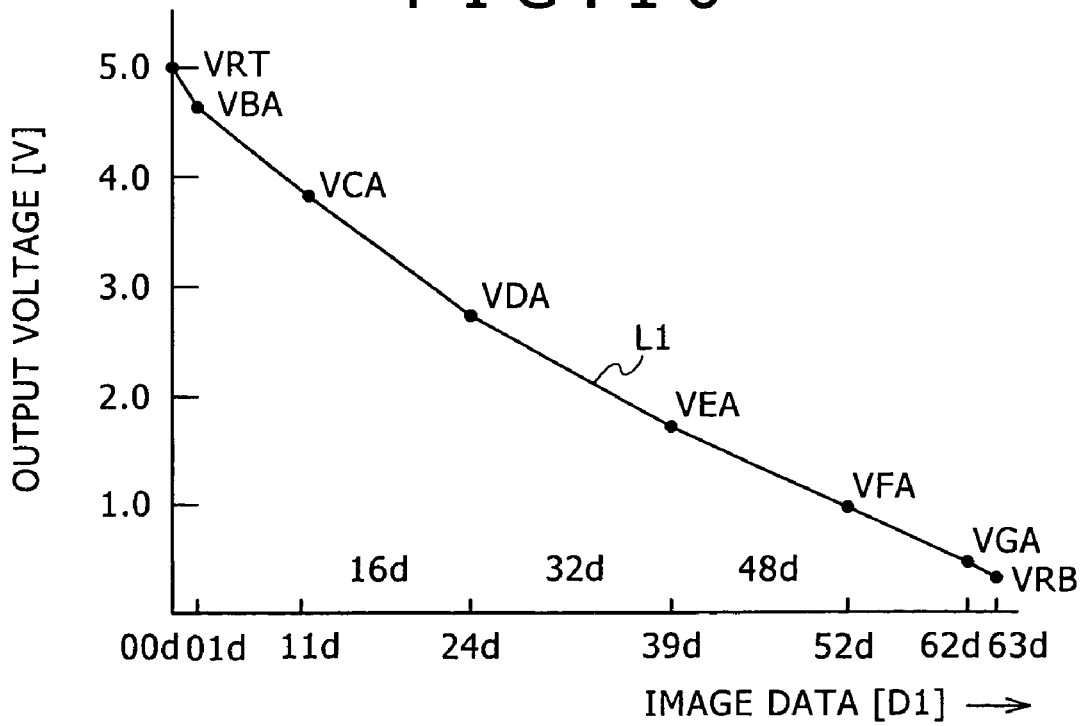
FIG. 10 is a characteristic diagram illustrating a gamma characteristic relating to a natural picture in the personal digital assistant of FIG. 1.
Figure 11:
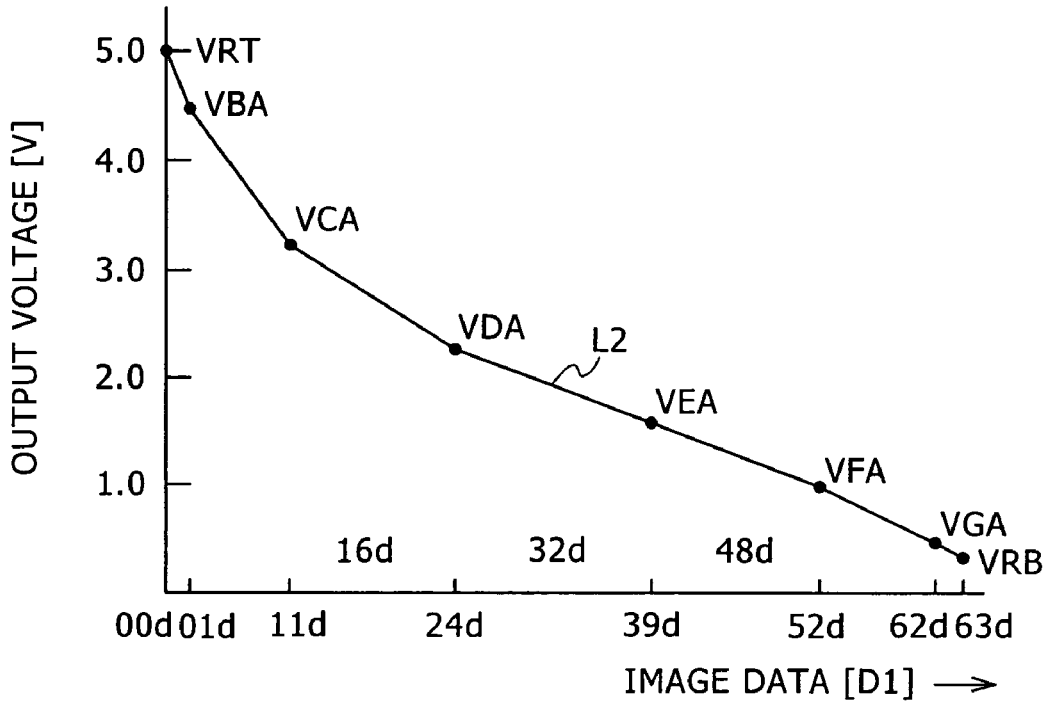
FIG. 11 is a characteristic diagram illustrating a gamma characteristic relating to a menu in the personal digital assistant of FIG. 1.

FIGS. 10 and 11 are characteristic diagrams illustrating the setting of gamma characteristics for a natural picture and for a menu depending upon the original reference voltages VRT, VBA to VGA, VBB to VGB, VRB where the black level original reference voltage VRT and the white level original reference voltage VRB are set to 5 V and 0 V, respectively. As seen from FIGS. 10 and 11, according the present embodiment, even where a plurality of different kinds of display objects is displayed at a time, can be displayed with gamma characteristics individually suitable for the display objects, and consequently, display images of a high quality can be formed.

A decoder 95 successively fetches the original reference voltage setting data DV in the form of serial data outputted from the controller 47 and distributes and outputs the original reference voltage setting data DV to the digital to analog conversion circuit 71, gamma setting circuits 81A and 81B and digital to analog conversion circuit 72 at timings corresponding to the changeover of contacts of the selectors 17A to 17N.

2. Operation of the Embodiment

In the PDA 41 (FIG. 1) having such a configuration as described above, image data DR to DB to be used for display are inputted from the apparatus body 42 to the controller 47 and time division multiplexed through the memory 52 so that image data of the same colors may be contiguous in a unit of a line. Then, image data D1 which are a result of the time division multiplexing process are inputted to the horizontal drive circuit 49. In the horizontal drive circuit 49, the image data D1 are fetched into the shift register 60, and the image data of the same colors are inputted simultaneously and concurrently into the digital to analog conversion circuits 61A to 61N in a unit of a line. Further, the image data are converted into driving signals by a digital to analog conversion process by the digital to analog conversion circuits 61A to 61N, and the driving signals are inputted to the selectors 17A to 17N through the amplification circuits 16A to 16N, respectively. Consequently, the image data D1 are distributed to the combinations of the pixels of red, green and blue formed from electronic EL elements, which are disposed successively and cyclically in a horizontal direction in the order of red, green and blue in the memory 45. Thereafter, the image data D1 are converted into driving signals, which are distributed to the signal lines SIG for the red, green and blue pixels by the selectors 17A to 17N. As a result, in the PDA 41, the gradations of the individual pixels are set in accordance with the image data DR to DB to display a desired image.

When a digital to analog conversion process is applied to the image data D1 to produce driving signals in this manner, in the PDA 41, the reference voltage production circuit 63 produces two systems of reference voltages V1A to V64A and V1B to V64B, and a gamma changeover signal GSEL for indicating the gamma characteristics based on the two systems of reference voltages V1A to V64A and V1B to V64B is outputted from the apparatus body 42 to a display object. In the PDA 41, such gamma changeover signals GSEL are distributed to the digital to analog conversion circuits 61A to 61N by the shift register 60 together with the corresponding image data D1, and one of the reference voltages V1A to V64A and V1B to V64B is selected by each of the digital to analog conversion circuits 61A to 61N based on the gamma changeover signal GSEL1 distributed in this manner. Then, the thus selected reference voltages V1A to V64A or V1B to V64B are further selected with the image data D1 to produce driving signals.

Consequently, a display screen of the display section 44 formed with the driving signals is displayed with the two different gamma characteristics corresponding to the reference voltages V1A to V64A and V1B to V64B. Consequently, even where different types of display objects are displayed in a mixed manner, they can be displayed with gamma characteristics individually suitable therefor. Thus, a plurality of different display objects can be displayed individually with appropriate gamma characteristics at a time.

In particular, in this instance, the apparatus body 42 sets, for image data for a natural picture, the gamma changeover signal GSEL so as to select the reference voltages V1A to V64A for a natural picture, but sets, for image data for a menu, the gamma changeover signal GSEL so as to select the reference voltages V1B to V64B for a menu. Consequently, a natural picture and a menu can be displayed with gamma characteristics appropriate for the natural picture and the menu, respectively.

In the PDA 41 (FIG. 6) wherein the gamma characteristic is changed over by changeover of the reference voltages V1A to V64A and V1B to V64B in this manner, the reference voltages V1A to V64A and V1B to V64B are produced by dividing the original reference voltages VRT, VBA to VGA, VRB and VRT, VBB to VGB, VRB by means of the resistor series circuits 26A and 26B each formed from a series connection of resistors R1 to R7.

Consequently, in the PDA 41, the two systems of reference voltages V1A to V64A and V1B to V64B can be produced by polygonal line approximation depending upon the original reference voltages VRT, VBA to VGA, VRB and VRT, VBB to VGB, VRB using the resistor series circuits 26A and 26B having the same configuration. Consequently, the setting upon design of the gamma characteristics by setting of the original reference voltages VRT, VBA to VGA, VRB and VRT, VBB to VGB, VRB can be simplified.

Further, from among the original reference voltages VRT, VBA to VGA, VRB and VRT, VBB to VGB, VRB, the original reference voltages VRT and VRB for the black level and the white level are produced from the corresponding original reference voltage setting data DVVRT and DVVRB, respectively, and the remaining two systems of original reference voltages VBA to VGA and VBB to VGB are produced from the corresponding two systems of original reference voltage setting data DVVBA to DVVGA and DVVBB to DVVGB, respectively, by the original reference voltage production circuit 62.

Consequently, in the PDA 41, the original reference voltages VRT, VBA to VGA, VRB and VRT, VBB to VGB, VRB are set with the original reference voltage setting data DV to set desired gamma characteristics, and, in this state, the original reference voltage setting data DVVRT and DVVRB are adjusted to set the white level and the black level for each color and for each product to correct the dispersion in light emission characteristic among organic EL devices so that the gamma characteristics themselves may not be varied at all, and the adjustment operation for the organic EL devices can be simplified as much. Also, where the original reference voltage setting data DVVRT and DVVRB are adjusted similarly to correct a secular change, it is possible to prevent the gamma characteristics from being altered at all, and the adjustment operation for the organic EL devices can be simplified as much.

In particular, an organic EL device has a light emission characteristic which varies for each product and for each color and varies by a secular change. It is known that the variation of the light emission characteristic of the organic EL device appears as a variation in black level and white level while the gamma characteristic itself does not vary. Thus, if the original reference voltages VRT and VRB are used as a reference to produce the remaining original reference voltages VBA to VGA and VBB to VGB and the original reference voltages VRT and VRB are used commonly by the two systems of original reference voltages VBA to VGA and VBB to VGB, then even if the original reference voltages VRT and VRB vary as a result of adjustment of the white level or the black level, the original reference voltages VBA to VGA and VBB to VGB vary following up the variation of the original reference voltages VRT and VRB in accordance with the resistor voltage dividing ratios by the voltage dividing circuits 83B to 83G and 93B to 93G. Consequently, variation of the gamma characteristics can be prevented and an operation to adjust the gamma characteristic again can be eliminated, and the adjustment operation can be simplified as much.

3. Effects of the Invention

With the PDA 41 having the configuration described above, a plurality of systems of reference voltages having different gamma characteristics are produced and one of the systems is selected in response to a selection signal, and the selected reference voltages are selected in response to image data to set the gradations of the individual pixels. Consequently, different display objects can be displayed at a time individually with appropriate gamma characteristics.

Further, since each of the plurality of systems of reference voltages is produced by dividing a plurality of systems of original reference voltages by means of a resistor series circuit, the plural systems of reference voltages can be produced in a similar manner individually by setting the original reference voltages. Consequently, the gamma characteristics can be set simply and easily as much.

Further, since original reference voltage setting data are converted from digital into analog data to produce the original reference voltages such that the original reference voltages for the black level and the white level are used commonly between the plural systems, the adjustment operation can be simplified.

Second Embodiment

Figure 12:
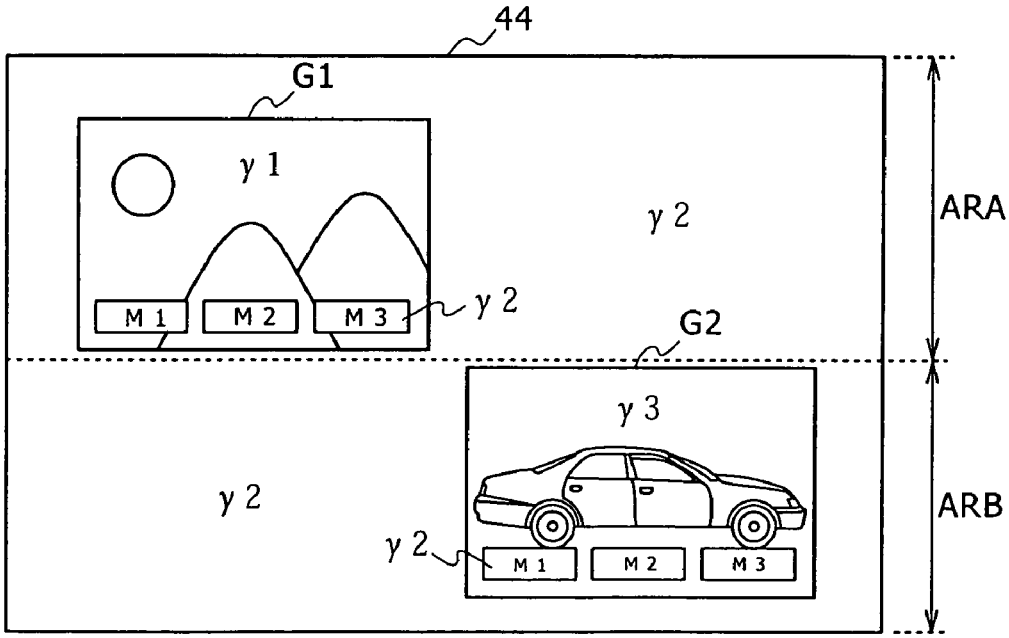
FIG. 12 is a plan view showing a display screen of a personal digital assistant according to a second embodiment of the present invention.

FIG. 12 shows in plan view a display screen by a PDA according to a second embodiment of the present invention. The PDA has a configuration the same as that of the PDA 41 of the first embodiment described hereinabove except for a process executed by the controller 43 of the apparatus body 42 and control of the controller 47 relating to the process. Therefore, a description of the second embodiment is given below in connection with the configuration of the first embodiment.

In the present embodiment, the controller 43 operates in response to an operation of a user so that natural pictures G1 and G2 are displayed above and below an imaginary borderline substantially at a vertical central position of a display screen of the display section 44. Further, menus are displayed in the area of each of the natural pictures G1 and G2. The controller 43 displays a further menu in an overlapping relationship in response to selection of one of the displayed menus by the user and accepts adjustment of the gamma characteristic regarding the natural picture G1 or G2 by an operation of the further menu.

The controller 43 produces original reference voltage setting data DVVBA to DVVGA corresponding to original reference voltage setting data DVVBA to DVVGA for natural pictures stored in the memory 45 with gamma characteristics set by such adjustment of the gamma characteristics. The controller 43 outputs the original reference voltage setting data DVVBA to DVVGA produced depending upon the setting of the user at a timing immediately before the image data DR, DG and DB for each line are outputted in the regions ARA and ARB in which the natural pictures G1 and G2 are displayed, respectively, to the original reference voltage setting circuit 56. The original reference voltage setting data DVVBA to DVVGA outputted from the controller 43 are inputted to the encoder 56B in place of the original reference voltage setting data DVVBA to DVVGA for a natural picture outputted from the memory control circuit 55 depending upon the setting of the selector 56C.

Further, within a period within which the image data DR, DG and DB for the natural pictures G1 and G2 are outputted to the controller 47 in this manner, the controller 43 outputs the gamma changeover signal GSEL so that the reference voltages V1A to V64A based on the original reference voltage setting data DVVBA to DVVGA outputted from the controller 43 may be selected, but within any other period, the controller 43 outputs the gamma changeover signal GSEL so that the reference voltages V1B to V64B based on the original reference voltage setting data DVVBB to DVVGB for menus from the memory control circuit 55 may be selected.

Consequently, in the present embodiment, in the upper side region ARA of the display screen, the natural picture G1 is displayed with a gamma $\gamma$1 depending upon the setting of the user while the menus and the background are displayed with another gamma $\gamma$2 for a menu recorded in the memory 45. Meanwhile, in the lower side region ARB of the display screen, the natural picture G2 is displayed with a gamma $\gamma$3 depending upon the setting of the user while the menus and the background are displayed with the gamma $\gamma$2 for a menu recorded in the memory 45.

Also, where two systems of reference voltages are selected to produce driving signals and the reference voltages are changed over for each line as in the embodiment described above, a plurality of kinds of natural pictures and menus can be displayed individually with appropriate gamma characteristics.

Third Embodiment

Figure 13:
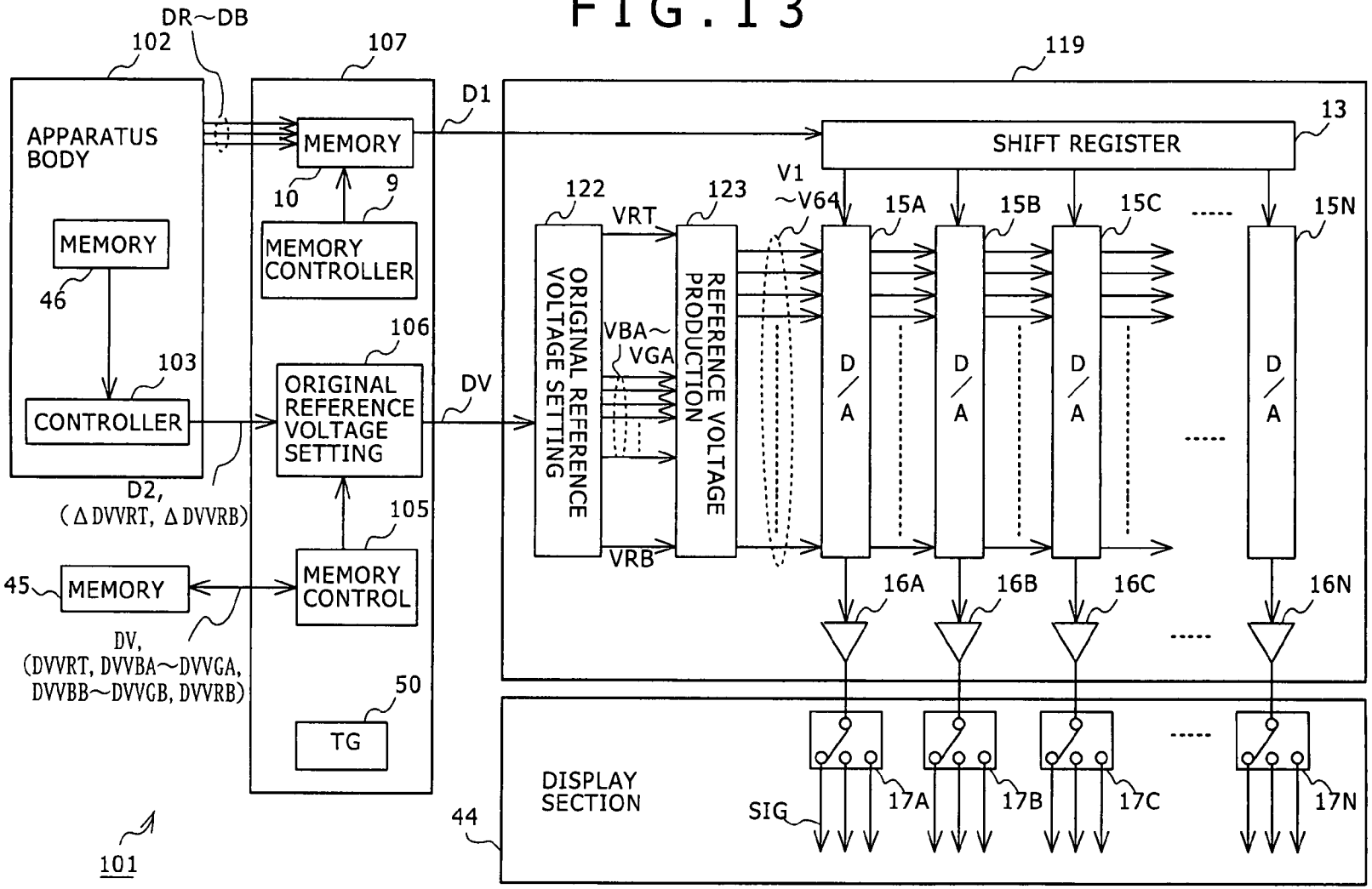
FIG. 13 is a block diagram showing a personal digital assistant according to a third embodiment of the present invention.
Figure 14:
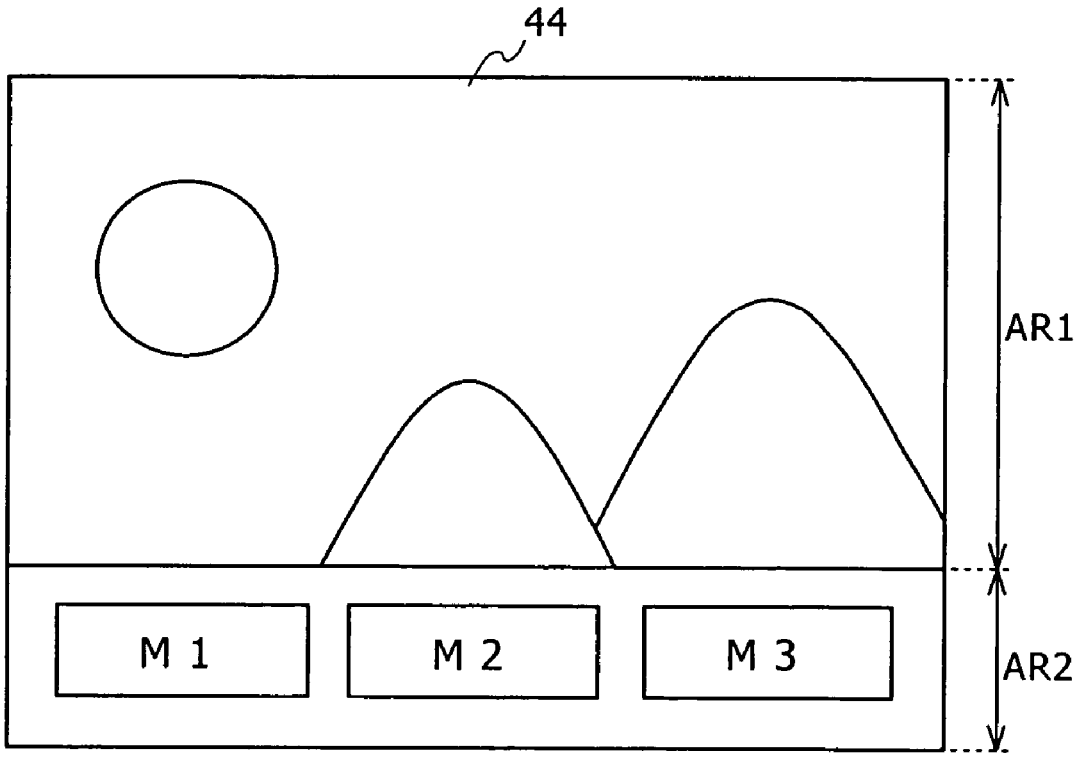
FIG. 14 is a plan view showing a display screen of the personal digital assistant of FIG. 13.

FIG. 13 shows in a block diagram a PDA according to a third embodiment of the present invention. It is to be noted that, in this PDA 101, elements like those of a PDA 41 described in the first embodiment and related art described in FIG. 17 are denoted by like reference characters and an overlapping description of them is omitted herein to avoid redundancy.

Referring to FIG. 13, the PDA 101 shown includes an apparatus body 102 which forms, under the control of a controller 103, a display region AR2 for displaying only a menu therein at a lower portion of a display screen of a display section 44, and sets the remaining area AR1 as a display region AR1 for displaying only a natural picture therein. The controller 103 outputs image data DR, DG and DB of a natural picture and a menu in accordance with the setting of the regions AR1 and AR2.

A controller 107 time division multiplexes the image data DR, DG and DB to produce image data D1 and outputs the image data D1. Further, when a natural picture is to be displayed in the display region AR1 for a natural picture, a memory control circuit 105 in the controller 107 reads out, under the control of the controller 103, original reference voltage setting data DVVBA to DVVGA for a natural picture stored in the memory 45 from the memory 45 for each line together with original reference voltage setting data DVVRT and DVVRB for the black level and the white level and outputs the read out data to an original reference voltage setting circuit 106. On the other hand, when a menu is to be displayed in the display region AR2 for a menu, the memory control circuit 105 reads out, under the control of the controller 103, original reference voltage setting data DVVBB to DVVGB for a menu stored in the memory 45 from the memory 45 for each line together with original reference voltage setting data DVVRT and DVVRB for the black level and the white level from the memory 45 and outputs the read out data to the original reference voltage setting circuit 106.

The original reference voltage setting circuit 106 corrects the original reference voltage setting data DVVRT and DVVRB outputted in this manner with correction data D2 outputted from the controller 103 and outputs the corrected data to a horizontal drive circuit 119 together with the original reference voltage setting data DVVBA to DVVGA or DVVBB to DVVGB. Consequently, in the present embodiment, the original reference voltage setting data DVVBA to DVVGA or DVVBB to DVVGB according to the setting of the gamma characteristics are changed over in a unit of a line and outputted in one system.

The horizontal drive circuit 119 successively fetches the image data D1 successively inputted thereto into the shift register 13 and outputs the image data D1 for the individual colors to the digital to analog conversion circuits 15A to 15N. The digital to analog conversion circuits 15A to 15N perform a digital to analog conversion process for the image data D1 to produce driving signals. In the present embodiment, reference voltages V1 to V64 for the digital to analog conversion circuits 15A to 15N are produced from the original reference voltage setting data DVVBA to DVVGA or DVVBB to DVVGB outputted in a single system by changeover in a unit of a line.

In particular, in the present embodiment, an original reference voltage production circuit 122 is formed in a configuration wherein the gamma setting circuit 81B is omitted from the original reference voltage production circuit 62 shown in FIG. 6. Consequently, the original reference voltages VRT, VBA to VGA, VRB and VRT, VBB to VGB, VRB are produced switchably in response to the original reference voltage setting data DVVBA to DVVGA or DVVBB to DVVGB outputted in a single system as a result of changeover in a unit of a line and the original reference voltage setting data DVVRT and DVVRB for the black level and the white level.

A reference voltage production circuit 123 is formed in such a configuration that the resistor series circuit 26B is omitted from the reference voltage production circuit 63 shown in FIG. 6. Consequently, the reference voltages V1 to V64 are produced wherein the gamma characteristic is changed over in a unit of a line with the original reference voltages VRT, VBA to VGA, VRB and VRT, VBB to VGB, VRB outputted from the original reference voltage production circuit 122.

Consequently, in the present embodiment, the gamma characteristic is changed over in a unit of a line such that a natural image and a menu are displayed individually with appropriate gamma characteristics.

Fourth Embodiment

Figure 15:
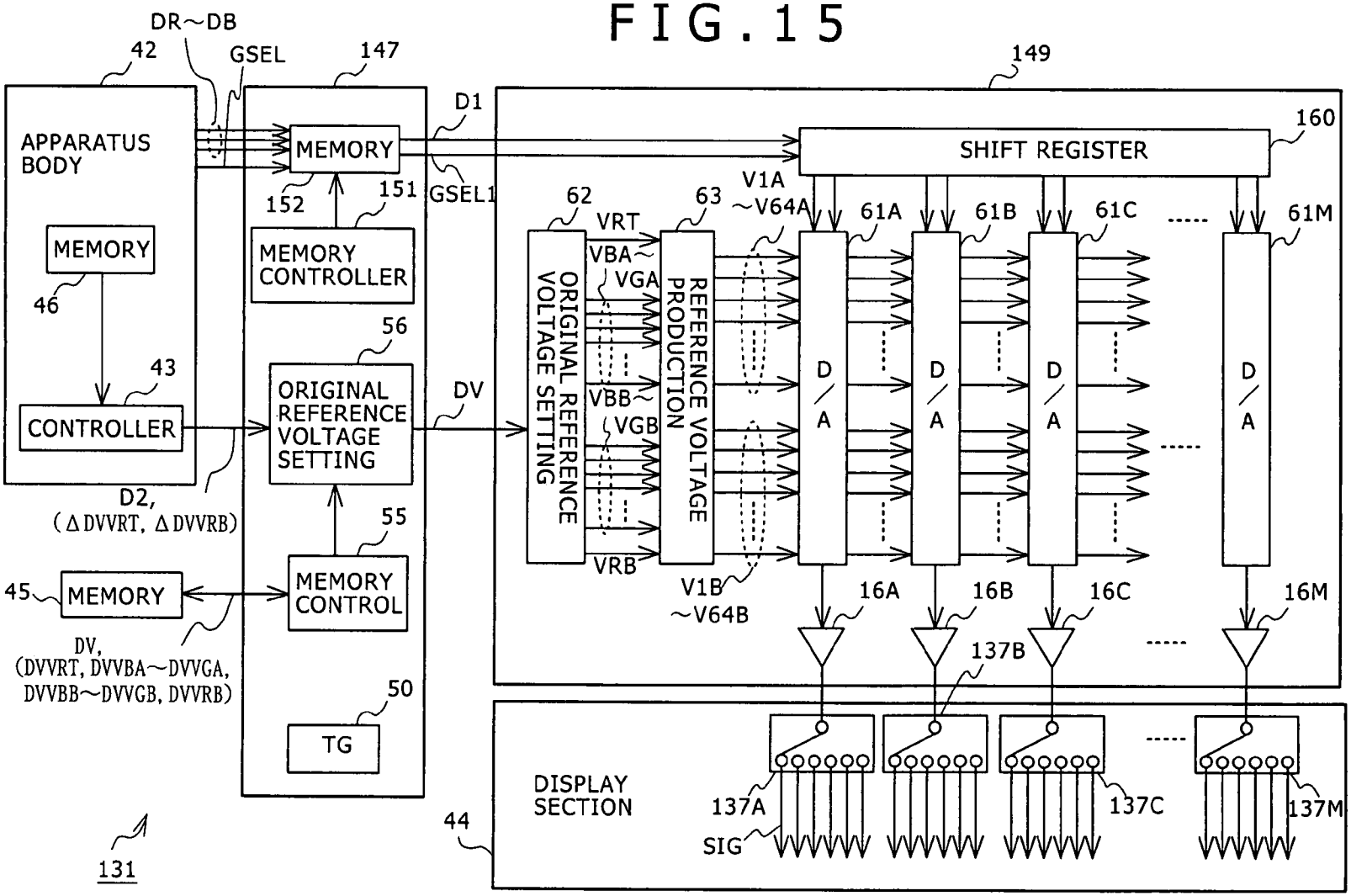
FIG. 15 is a block diagram showing a personal digital assistant according to a fourth embodiment of the present invention.
Figure 16:
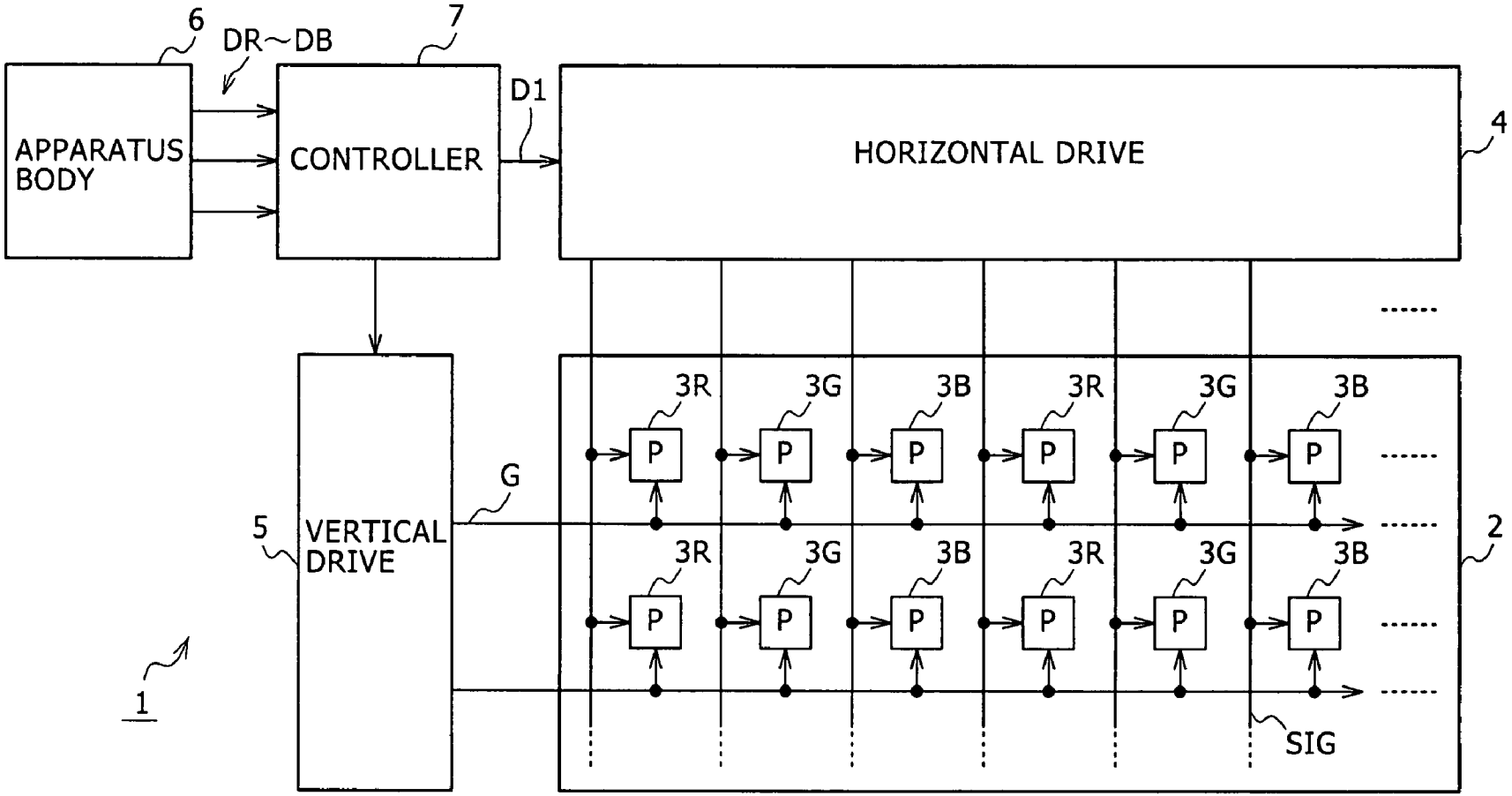
FIG. 16 is a block diagram showing a conventional liquid crystal display apparatus.

FIG. 15 shows in a block diagram a PDA according to a fourth embodiment of the present invention.

In the present embodiment, the PDA 131 is configured such that selectors 137A to 137M for distributing driving signals to signal lines SIG output the driving signals successively in a circulating fashion to a plurality of sets of pixels to display a color image. More particularly, in the present embodiment, the PDA 131 is formed such that the selectors 137A to 137M distribute and output driving signals to two sets of pixels to display a color image so that the number of systems of driving signals to be produced by a horizontal drive circuit 149 is reduced to ½ when compared with the PDA 41 described hereinabove with reference to FIG. 1.

In the present PDA 131, image data of red, green and blue are multiplexed to produce image data D1 and the image data D1 are outputted by a process of a memory control circuit 151 and a memory 152 of a controller 147 so as to cope with the distribution of driving signals from the selectors 137A to 137M. The horizontal drive circuit 149 distributes the image data by means of a shift register 160, and digital to analog conversion circuits 61A to 61M convert the distributed image data into driving signals.

Consequently, in the present PDA 131, the number of digital to analog conversion circuits 61A to 61M is reduced to one half, and two systems of reference voltages V1A to V64A and V1B to B64B are processed by the digital to analog conversion circuits 61A to 61M. Consequently, the occupied area by the digital to analog conversion circuits 61A to 61M on an integrated circuit which increases where a system of reference voltages are to be processed is kept substantially equal to that where one system of reference voltages are to be processed, and an increase of the chip area by the horizontal drive circuit 149 is prevented as much.

Other Embodiments

It is to be noted that, while, in the embodiments described hereinabove, reference voltages are produced in two systems and the gamma characteristic is changed over, the present invention is not limited to this, but reference voltages may be produced in three or more systems and the gamma characteristic may be changed over among them.

Further, while in the embodiments described above, the present invention is applied to a flat display apparatus that is formed using organic EL devices, the present invention is not limited to this, but it can be applied widely to various video apparatus.

Further, while in the embodiments described above, the present invention is applied to a PDA, the present invention is not limited to this, but it can be applied widely to various video apparatus.

In particular, the present invention can be applied to drive circuits for a flat display apparatus and a flat display apparatus and applied, for example, to a display apparatus that is configured using organic EL devices.

While preferred embodiments of the present invention have been described using specific terms, such description is for illustrative purpose only, and it is to be understood that changes and variations may be made without departing from the spirit or scope of the following claims.

What is claimed is:

1. A drive circuit for a flat display apparatus wherein driving signals are produced by a digital to analog conversion processing of image data and are used to drive signal lines of a display section wherein pixels are arranged in a matrix, comprising:

an original reference voltage production circuit for producing a plurality of original reference voltages;

a reference voltage production circuit including a resistor series circuit formed from a plurality of voltage dividing circuits connected in series and each including a plurality of resistors connected in series for receiving the original reference voltages at the opposite ends of and at nodes between said voltage dividing circuits of said resistor series circuit and outputting divided voltages by said voltage dividing circuits as a plurality reference voltages; and a driving signal digital to analog conversion circuit for receiving the reference voltages as inputs thereto and selectively outputting the inputted reference voltages in accordance with the image data for the corresponding ones of said signal lines as the driving signals;

said reference voltage production circuit producing the reference voltages in a plurality of systems having different gamma characteristics;

said driving signal digital to analog conversion circuit selecting the reference signals of one of the plural systems and selectively outputting the selected reference voltages in response to the image data.

2. The drive circuit for a flat display apparatus according to claim 1, further comprising a selector for outputting the driving signals outputted from digital to analog conversion circuits for said signal lines successively in a circulating manner to a plurality of sets of the pixels used to display a color image.

3. The drive circuit for a flat display apparatus according to claim 1, wherein said original reference voltage production circuit produces and outputs the reference voltages in a plurality of systems individually corresponding to the systems of the reference voltages, and said reference voltage production circuit divides the original reference voltages of the individual systems by means of a plurality of systems of such resistor series circuits individually corresponding to the systems of the reference voltages to produce the reference voltages of the plural systems and outputs the produced reference voltages in the plurality of systems.

4. The drive circuit for a flat display apparatus according to claim 3, wherein said original reference voltage production circuit includes a plurality of original reference voltage digital to analog conversion circuits for performing a digital to analog conversion process for original reference voltage setting data to produce the original reference voltages, the original reference voltages for a black level and a white level of each of the systems of the original reference voltages being produced by the original reference voltage digital to analog conversion circuit common to the plural systems.

5. A flat display apparatus for displaying an image based on image data, comprising:

a display section including pixels arranged in a matrix;

a horizontal drive circuit for producing driving signals from the image data and driving signal lines of said display section with the driving signals; and a body apparatus for outputting image data to said horizontal drive circuit;

said body apparatus outputting selection signals for indicating selection of gamma characteristics to be used to display the image data to said horizontal drive circuit together with the image data;

said horizontal drive circuit including an original reference voltage production circuit for producing a plurality of original reference voltages, a reference voltage production circuit including a resistor series circuit formed from a plurality of voltage dividing circuits connected in series and each including a plurality of resistors connected in series for receiving the original reference voltages at the opposite ends of and at nodes between said voltage dividing circuits of said resistor series circuit and outputting divided voltages by said voltage dividing circuits as a plurality reference voltages, and a driving signal digital to analog conversion circuit for receiving the reference voltages as inputs thereto and selectively outputting the inputted reference voltages in accordance with the image data for the corresponding ones of said signal lines as the driving signals;

said reference voltage production circuit producing the reference voltages in a plurality of systems having different gamma characteristics;

said driving signal digital to analog conversion circuit selecting the reference signals of one of the plural systems and selectively outputting the selected reference voltages in response to the image data.

6. The flat display apparatus according to claim 5, wherein said horizontal drive circuit further includes a selector for outputting the driving signals outputted from digital to analog conversion circuits for said signal lines successively in a circulating manner to a plurality of sets of the pixels used to display a color image.

7. The flat display apparatus according to claim 5, wherein, in response to selection of one of the systems of reference voltages in accordance with the selection signal, the gamma characteristic for display of said display section is changed over within a region of a predetermined range in a horizontal direction and/or a vertical direction in one screen.

8. The flat display apparatus according to claim 5, wherein said original reference voltage production circuit produces and outputs the reference voltages in a plurality of systems individually corresponding to the systems of the reference voltages, and said reference voltage production circuit divides the original reference voltages of the individual systems by means of a plurality of systems of such resistor series circuits individually corresponding to the systems of the reference voltages to produce the reference voltages of the plural systems and outputs the produced reference voltages in the plurality of systems.

9. The flat display apparatus according to claim 8, wherein said original reference voltage production circuit includes a plurality of original reference voltage digital to analog conversion circuits for performing a digital to analog conversion process for original reference voltage setting data to produce the original reference voltages, the original reference voltages for a black level and a white level of each of the systems of the original reference voltages being produced by the original reference voltage digital to analog conversion circuit common to the plural systems.

* * * * *